US010906762B2

(12) United States Patent
Sakaguchi

(10) Patent No.: US 10,906,762 B2
(45) Date of Patent: Feb. 2, 2021

(54) SHEET CONVEYANCE APPARATUS AND IMAGE FORMING APPARATUS

(71) Applicant: CANON KABUSHIKI KAISHA, Tokyo (JP)

(72) Inventor: Ryou Sakaguchi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/862,604

(22) Filed: Apr. 30, 2020

(65) Prior Publication Data

US 2020/0363763 A1 Nov. 19, 2020

(30) Foreign Application Priority Data

May 15, 2019 (JP) ..... 2019-091952
Apr. 9, 2020 (JP) ..... 2020-070552

(51) Int. Cl.

*B65H 7/20* (2006.01)
*G03G 15/00* (2006.01)
*B65H 7/02* (2006.01)
*B65H 5/06* (2006.01)

(Continued)

(52) U.S. Cl.

CPC ..... *B65H 7/20* (2013.01); *B65H 5/062* (2013.01); *B65H 5/26* (2013.01); *B65H 7/02* (2013.01); *B65H 85/00* (2013.01); *G03G 15/6529* (2013.01); *G03G 15/6558* (2013.01); *B65H 2511/30* (2013.01); *B65H 2513/514* (2013.01);

(Continued)

(58) Field of Classification Search

CPC . B65H 5/06; B65H 5/062; B65H 5/26; B65H 7/00; B65H 7/02; B65H 7/14; B65H 7/20; B65H 85/00; B65H 2511/30; B65H 2513/50; B65H 2513/512; B65H 2513/514; B65H 2601/12; B65H 2601/121; B65H 2601/2525; B65H 2601/255; B65H 2515/842; G03G 15/6529; G03G 15/6558; G03G 15/6564

See application file for complete search history.

(56) References Cited

U.S. PATENT DOCUMENTS 5,873,664 A 2/1999 Umemo
9,550,643 B2 1/2017 Matsumoto et al.
2017/0088375 A1 3/2017 Matsumoto et al.

(Continued)

FOREIGN PATENT DOCUMENTS

JP H11-5651 A 1/1999
JP 2010-215345 A 9/2010

(Continued)

*Primary Examiner* — Prasad V Gokhale
(74) *Attorney, Agent, or Firm* — Venable LLP

(57) ABSTRACT

A sheet conveyance apparatus includes a control unit for executing a stop process of stopping a second sheet in a state in which the second sheet is nipped by a second conveyance portion, and a conveyance restart process of restarting conveyance of the second sheet stopped by the second conveyance portion. The control unit has a first mode in which the conveyance restart process is performed at a first timing at which a first time has elapsed since a first sheet has passed a reference position, and a second mode in which the conveyance restart process is performed at a second timing at which a second time longer than the first time has elapsed since the first sheet has passed the reference position.

18 Claims, 10 Drawing Sheets

(51) Int. Cl.
*B65H 5/26* (2006.01)
*B65H 85/00* (2006.01)

(52) U.S. Cl.
CPC .. *B65H 2515/842* (2013.01); *B65H 2601/255* (2013.01); *B65H 2601/2525* (2013.01)

(56) References Cited

U.S. PATENT DOCUMENTS

2018/0046126 A1* 2/2018 Kanno ..... G03G 15/043
2018/0157200 A1* 6/2018 Endoh ..... G03G 15/6579

FOREIGN PATENT DOCUMENTS

JP 2014-084209 A 5/2014
JP 2015-199551 A 11/2015

* cited by examiner

FIG.7A

| | CONVEYANCE EFFICIENCY | CONVEYANCE SPPED OF SHEET WHEN DRIVING SPEED OF PRE-REGISTRATION MOTOR IS 200 mm/sec |
|---|---|---|
| WHEN PRE-REGISTRATION ROLLER IS NEW | 100% | 200mm/sec |
| WHEN DUPLEX ROLLER IS NEW | 100% | 200mm/sec |

FIG.7B

| | CONVEYANCE EFFICIENCY | CONVEYANCE SPPED OF SHEET WHEN DRIVING SPEED OF PRE-REGISTRATION MOTOR IS 222.2 mm/sec |
|---|---|---|
| WHEN NUMBER OF SHEETS CONVEYED BY PRE-REGISTRATION ROLLER IS 300,000 | 90% | 200mm/sec |
| WHEN NUMBER OF SHEETS CONVEYED BY DUPLEX ROLLER IS 150,000 | 95% | 211.1mm/sec |

FIG.7C

| | CONVEYANCE EFFICIENCY | CONVEYANCE SPPED OF SHEET WHEN DRIVING SPEED OF PRE-REGISTRATION MOTOR IS 200 mm/sec |
|---|---|---|
| WHEN PRE-REGISTRATION ROLLER IS NEW | 100% | 200mm/sec |
| WHEN NUMBER OF SHEETS CONVEYED BY DUPLEX ROLLER IS 150,000 | 95% | 190mm/sec |

SHEET CONVEYANCE APPARATUS AND IMAGE FORMING APPARATUS

BACKGROUND OF THE INVENTION

Field of the Invention

The present invention relates to a sheet conveyance apparatus that conveys a sheet and an image forming apparatus including the sheet conveyance apparatus.

Description of the Related Art

In a roller pair provided on a conveyance path for conveying sheets in an image forming apparatus such as a printer, as the number of sheets conveyed increases, the deterioration of components such as abrasion of the roller surface progresses, and the frictional force for conveying the sheet decreases. When the frictional force decreases, the speed at which the sheet is conveyed by the roller pair also decreases, which causes a delay in sheet conveyance. On the other hand, JP-A-2010-215345 discloses an image forming apparatus that conveys a sheet at a constant speed by controlling the rotational speed of a motor that drives a roller pair according to the deterioration condition of the roller. In addition, JP-A-2014-84209 discloses an image forming apparatus in which the number of motors used for sheet conveyance is reduced by rotating a plurality of conveyance roller pairs with one motor, thereby achieving low cost.

In JP-A-2014-84209, a drive force is transmitted from one motor to a plurality of roller pairs. In this case, for example, when there is a difference in the deterioration condition of each of the plurality of roller pairs, as a result, a difference also occurs in the sheet conveyance speed of each of the roller pairs, and a jam is likely to occur.

SUMMARY OF THE INVENTION

According to one aspect of the present invention, a sheet conveyance apparatus includes a first conveyance path, a second conveyance path that merges with the first conveyance path at a merging portion, a first conveyance portion configured to convey a first sheet in the first conveyance path, a second conveyance portion configured to convey a second sheet toward the merging portion in the second conveyance path, a driving unit configured to drive the first conveyance portion and the second conveyance portion, a drive force transmitting portion configured to transition between a transmission state in which a drive force from the driving unit is transmitted to drive the second conveyance portion and a non-transmission state in which a drive force from the driving unit is not transmitted to the second conveyance portion, and a control unit configured to execute a stop process of stopping the second sheet in a state in which the second sheet is nipped by the second conveyance portion by making the drive force transmitting portion be the non-transmission state, and a conveyance restart process of restarting conveyance of the second sheet stopped by the second conveyance portion by transitioning the drive force transmitting portion from the non-transmission state to the transmission state, wherein the control unit has a first mode in which the conveyance restart process is performed at a first timing at which a first time has elapsed since the first sheet has passed a reference position, and a second mode in which the conveyance restart process is performed at a second timing at which a second time longer than the first time has elapsed since the first sheet has passed the reference position.

Further features of the present invention will become apparent from the following description of exemplary embodiments with reference to the attached drawings.

BRIEF DESCRIPTION OF THE DRAWINGS

FIG. 7A is a table illustrating a state in which conveyance efficiencies and conveyance speeds of a pre-registration roller pair and a duplex roller pair according to the present embodiment are the same.

FIG. 7B is a table illustrating a state in which the conveyance efficiency and the conveyance speed of the duplex roller pair are greater than those of the pre-registration roller pair.

FIG. 7C is a table illustrating a state in which the conveyance efficiency and the conveyance speed of the duplex roller pair are smaller than those of the pre-registration roller pair.

DESCRIPTION OF THE EMBODIMENTS

Hereinafter, an image forming apparatus 1 according to the present disclosure will be described with reference to the drawings. The image forming apparatus 1 is a printer, a copier, a facsimile, a multifunction peripheral, or the like, and forms an image on a sheet used as a recording medium based on image information input from an external PC or image information read from a document.

Embodiment 1

Figure 1:
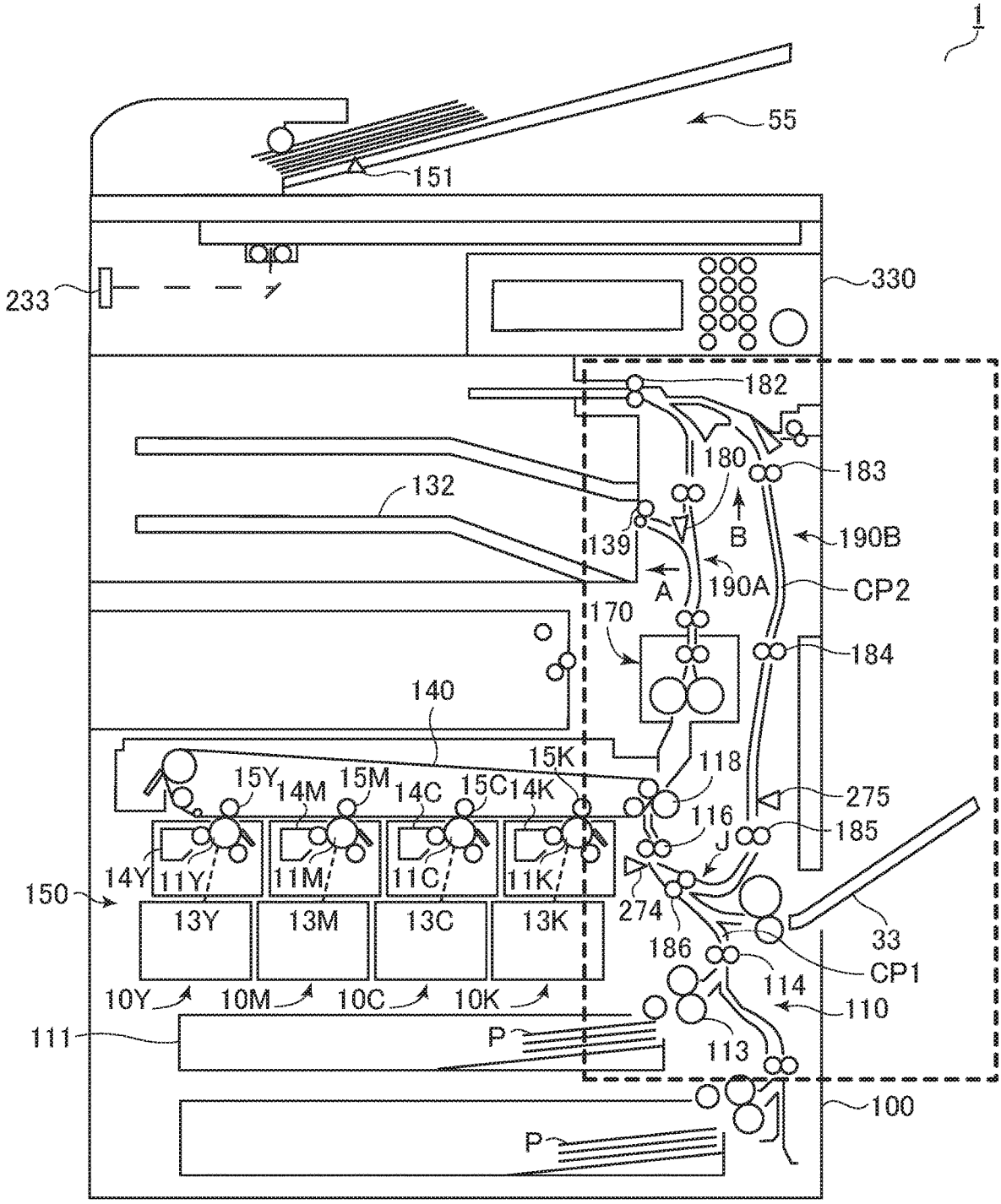
FIG. 1 is a schematic configuration diagram of an image forming apparatus according to a present embodiment.

FIG. 1 is a schematic configuration diagram of the image forming apparatus 1 including a sheet conveyance apparatus according to the present embodiment. The image forming apparatus 1 is a full-color laser printer of an electrophotographic system that forms an image on a sheet P and outputs the image. As the sheet P, paper such as plain paper and envelopes, glossy paper, plastic films such as overhead projector sheets, cloth, and the like can be used. An image forming engine 150 provided with four image forming units 10Y, 10M, 10C, and 10K that form yellow, magenta, cyan, and black toner images, and an intermediate transfer belt 140 is housed in an apparatus main body 100 of the image forming apparatus 1. The image forming units 10Y to 10K have photosensitive drums 11Y to 11K as image bearing members, respectively, and form toner images of respective colors on the photosensitive drums 11Y to 11K. The toner images carried on the photosensitive drums 11Y to 11K are transferred to the sheet P via the intermediate transfer belt 140 as an intermediate transfer member.

The image forming units 10Y to 10K have the same configuration except that the color of the toner used for development is different. Therefore, the configuration of the image forming unit and the toner image forming process (image forming operation) will be described using the yellow image forming unit 10Y as an example. The image forming unit 10Y has a charging roller, an exposing unit 13Y, a developing unit 14Y, a primary transfer roller 15Y, and a drum cleaner in addition to the photosensitive drum 11Y. The photosensitive drum 11Y is a drum-shaped photosensitive member having a photosensitive layer on an outer peripheral portion, and rotates in a direction along the direction of rotation of the intermediate transfer belt 140. The charging roller uniformly charges the surface of the photosensitive drum 11Y, and the exposing unit 13Y irradiates the photosensitive drum 11Y with a laser beam modulated in accordance with image information and performs an image writing operation of writing an electrostatic latent image on the surface of the photosensitive drum 11Y. The developing unit 14Y stores a developer containing toner, and supplies the toner to the photosensitive drum 11Y to develop the electrostatic latent image into a toner image. The toner image formed on the photosensitive drum 11Y is primarily transferred to the intermediate transfer belt 140 by the primary transfer roller 15Y. After the transfer, the toner remaining on the photosensitive drum 11Y is removed by a drum cleaner.

The intermediate transfer belt 140 is driven to rotate counterclockwise in FIG. 1. The above-described image forming operation proceeds in parallel in each of the image forming units 10Y to 10K, and a full-color toner image is formed on the intermediate transfer belt 140 by superimposing and multi-transferring the four color toner images. This toner image is carried on the intermediate transfer belt 140 and is conveyed to a transfer unit (secondary transfer unit 118) configured as a nip portion between a secondary transfer roller and a secondary transfer inner roller. A bias voltage having a polarity opposite to the charging polarity of the toner is applied to the secondary transfer roller serving as a transfer unit, and the toner image carried on the intermediate transfer belt 140 is secondarily transferred to the sheet P. After the transfer, the toner remaining on the intermediate transfer belt 140 is removed by a belt cleaner.

The sheet P to which the toner image has been transferred is delivered to a fixing unit 170. The fixing unit 170 has a fixing roller pair for nipping and conveying the sheet P and a heat source such as a halogen heater, and applies pressure and heat to the toner image carried on the sheet P. Thereby, the toner particles are melted and fixed, and a fixed image fixed on the sheet P is obtained. In the present embodiment, the image forming engine 150, the secondary transfer unit 118, and the fixing unit 170 cooperate to function as an image forming unit that forms an image on the sheet P.

The image forming apparatus 1 is provided with a UI 330 operated by a user and a document feeder 55 for reading a document sheet. By operating the UI 330, the user can set the printing conditions at the time of image formation, such as the color mode and the number of copies. Information input via the UI 330 is transferred to a control unit 300 illustrated in FIG. 2. In addition, by operating the UI 330 with a document set on the document feeder 55, the document can be read. When a document reading start instruction is input from the UI 330, the document is conveyed, and the document is irradiated with lamp light (not illustrated). The light reflected from the document is introduced into an image sensor 233, and read image data of the document is generated. The reading of the document is continued until the reading of the last document detected by a document presence sensor 151 is completed.

Next, a conveyance operation of the sheets P by the image forming apparatus 1 will be described. A feed cassette 111 stores the sheets P and is detachably attached to the apparatus main body 100. The sheets P stored in the feed cassette 111 are fed one by one by a sheet feed unit 110. The sheet feed unit 110 serving as a feeding portion according to the present embodiment includes a pickup roller 113 that sends out the sheet P from the feed cassette 111, and a feed roller 114 that receives the sheet P from the pickup roller 113 and conveys the sheet P. The sheet feed unit 110 includes a separating roller that separates a sheet P conveyed by the feed roller 114 from another sheet P. It is noted that the sheet feed unit 110 is an example of a feeding portion that feeds the sheet P, and may use a feeding portion of a belt type that suctions and conveys the sheet P to a belt member by a suction fan or a friction separation type using a pad. The user can directly set the sheet P on a manual feed tray 33 provided on the side of the apparatus main body 100, and the sheet P set on the manual feed tray 33 is fed by the sheet feed unit 110.

The sheet P sent from the sheet feed unit 110 to a first conveyance path CP1 is conveyed to a registration roller pair 116 by a pre-registration roller pair 186 serving as a first conveyance portion in the present embodiment. That is, the pre-registration roller pair 186 conveys the sheet P in the first conveyance path CP1. The registration roller pair 116 corrects the skew of the sheet P by contacting the leading edge of the sheet P, in other words, the downstream end in the sheet conveyance direction. A registration sensor 274, which is a first detection unit of the present embodiment, is provided between the pre-registration roller pair 186 and the registration roller pair 116 in the sheet conveyance direction. Thereafter, the registration roller pair 116 sends the sheet P to the secondary transfer unit 118 at a timing corresponding to the degree of progress of the image forming operation by the image forming units 10Y to 10K. The sheet P on which the toner image has been transferred in the secondary transfer unit 118 and the image has been fixed by the fixing unit 170 is conveyed toward a flap-shaped guide member 180 capable of switching a conveyance route of the sheet P.

In the case where the operation mode designated from the UI 330 is simplex printing and the image formation on the sheet P has been completed, the sheet P having an image formed on a first surface (front surface) is discharged to a sheet discharge tray 132 by a sheet discharge roller pair 139. Meanwhile, in the case where the operation mode designated from the UI 330 is two-side printing and an image is formed on a second surface (back surface) of the sheet P, the sheet P is delivered to a reverse conveyance roller pair 182 by the guide member 180. A reverse conveyance portion 190B according to the present embodiment includes the reverse conveyance roller pair 182 that reversely conveys (switches back) the sheet P, and a second conveyance path CP2 that guides the reversely conveyed sheet P toward the registration roller pair 116. The second conveyance path CP2 merges with the first conveyance path CP1 at a merging portion J. The reverse conveyance roller pair 182 is driven by a reverse motor (not illustrated), and conveys the sheet P toward the discharge space above the sheet discharge tray 132 by a predetermined distance, for example, until the upstream end of the sheet P in the direction of conveyance reaches the reverse conveyance roller pair 182, and then the sheet P is conveyed in the opposite direction. As a result, the sheet P is sent to the second conveyance path CP2. That is, the reverse conveyance roller pair 182 serving as a third conveyance portion conveys the sheet P as a first sheet conveyed through the first conveyance path CP1 in a first direction, and then conveys the sheet P in a second direction opposite to the first direction, thereby guiding the sheet P to the second conveyance path CP2.

The second conveyance path CP2 is provided with a duplex receiving roller pair 183, a conveyance roller pair 184, and a duplex roller pair 185. The sheet P sent to the second conveyance path CP2 is conveyed toward the duplex receiving roller pair 183, and is conveyed via the conveyance roller pair 184 to the duplex roller pair 185 serving as a second conveyance portion of the present embodiment. In the sheet conveyance direction, a duplex sensor 275, which is a second detection unit of the present embodiment, is provided between the conveyance roller pair 184 and the duplex roller pair 185. Then, when the leading edge of the reversely conveyed sheet P in the sheet conveyance direction reaches the duplex roller pair 185, the driving of a clutch 273 (see FIG. 3A) and the reverse motor is stopped, and the duplex roller pair 185 stops in a state in which the leading edge of the sheet P is nipped. It is noted that the duplex roller pair 185 may stop the sheet P in a state in which a portion other than the leading edge of the sheet P is nipped. Thereafter, when the image formation on the sheet P fed from the sheet feed unit 110, that is, the sheet P before being reversed is completed, the clutch 273 is driven again, and the conveyance of the sheet P which has been waiting by the duplex roller pair 185 is restarted. By the reverse conveyance, the image is transferred by the secondary transfer unit 118 to the back surface of the sheet P which has been waiting by the duplex roller pair 185, and the image is fixed by the fixing unit 170, and then discharged from the sheet discharge roller pair 139 to the sheet discharge tray 132.

It is noted that such an image forming operation is an example, and the present invention is not limited to the above configuration. For example, a direct transfer system in which a toner image formed on a photosensitive member is directly transferred to a sheet by a transfer unit may be used. An ink jet system or an offset printing system may be used as the configuration of the image forming unit.

Figure 2:
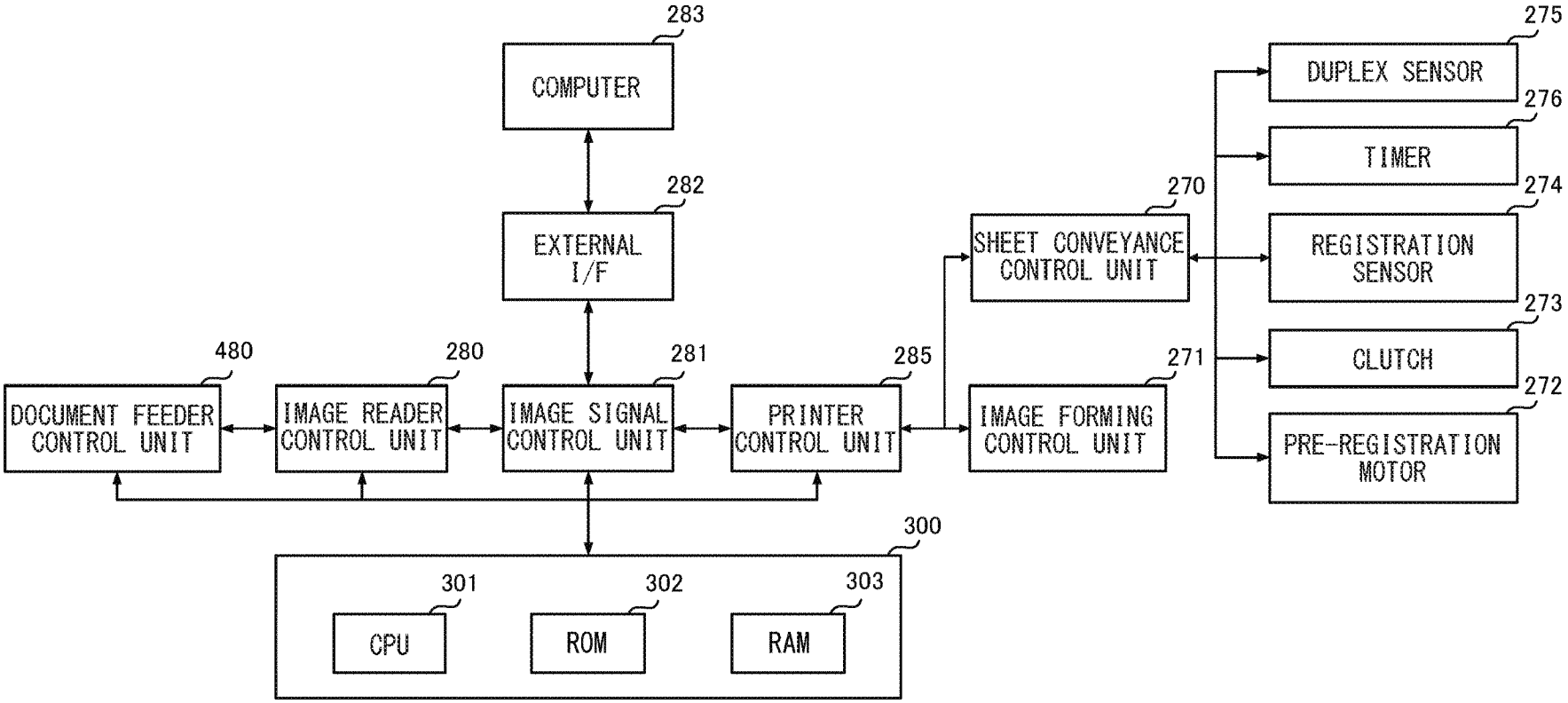
FIG. 2 is a control block diagram of the image forming apparatus according to the present embodiment.

Next, a control configuration of the image forming apparatus 1 will be described. FIG. 2 is a control block diagram of the image forming apparatus 1 according to the present embodiment. The control unit 300 has a CPU 301, a ROM 302, and a RAM 303. The CPU 301 is a calculation unit that controls the system of the image forming apparatus 1. The ROM 302 in which a control program for the image forming apparatus 1 is stored, and the RAM 303 in which a variable used for control, image data read by the image sensor 233 (see FIG. 1), and the like are temporarily stored are connected to the CPU 301 via a bus. The RAM 303 is a non-volatile memory that can hold the stored value even when the power supply to the image forming apparatus 1 is stopped, and is also used as a work area when the CPU 301 performs a calculation process. Further, programs for implementing a document feeder control unit 480, an image reader control unit 280, an image signal control unit 281, and a printer control unit 285 are stored in a storage medium such as the ROM 302 or the HDD. The CPU 301 executes these programs loaded from the ROM 302 or the HDD into the RAM 303, thereby implementing the document feeder control unit 480, the image reader control unit 280, the image signal control unit 281, and the printer control unit 285. The control unit 300 is a controller that integrally controls the document feeder control unit 480, the image reader control unit 280, the image signal control unit 281, and the printer control unit 285.

The document feeder control unit 480 controls the driving of the document conveyance roller of the document feeder 55, the detection of the presence or absence of a document by the document presence sensor 151, and the like. The image reader control unit 280 detects the opening/closing operation of the document plate of the document feeder 55, and controls the reading operation of the image sensor 233 on the document image on the glass plate of the document feeder 55 and the document image fed by the document feeder control unit 480. An analog image signal read by the image sensor 233 is transferred to the image signal control unit 281. When execution of a copy operation is set in a job, the image signal control unit 281 converts the analog image signal from the image sensor 233 into a digital image signal to perform image processing, and converts the digital image signal into a video signal to output the video signal to the printer control unit 285. When execution of a printing operation is set in the job, the image signal control unit 281 performs image processing on a digital image signal input from a computer 283 via an external I/F 282, and converts the digital image signal into a video signal to output the video signal to the printer control unit 285.

The printer control unit 285 inputs the video signal to an image forming control unit 271 based on an instruction from the control unit 300, and instructs the image forming control unit to execute an image forming operation. The image forming control unit 271 controls execution of an image forming operation. For example, first, the image forming control unit 271 starts temperature control of the fixing unit 170 as a preparation operation for performing image formation. In addition, the image forming control unit 271 executes, as a preparation operation, switching of a contact/separation state between the intermediate transfer belt 140 and the primary transfer rollers 15Y to 15K and drive control of the polygon motors in the image forming units 10Y to 10K. Then, when the state is switched to a state where the intermediate transfer belt 140 and the primary transfer rollers 15Y to 15K are in contact with each other, a video signal is acquired from the RAM 303, and the image forming units 10Y to 10K execute image formation.

The printer control unit 285 controls a sheet conveyance control unit 270 to execute sheet feeding and conveyance control based on the instruction from the control unit 300. The sheet conveyance control unit 270 controls a pre-registration motor 272, the clutch 273, and a timer 276 based on the sensor signals of the registration sensor 274 and the duplex sensor 275 to perform a conveyance operation of the sheet during duplex conveyance. The sensor outputs of the registration sensor 274 and the duplex sensor 275 change according to the presence or absence of a sheet at the detection position of each sensor. Here, it is assumed that the registration sensor 274 is configured to output an ON detection result when there is a sheet at the detection position and an OFF detection result when there is no sheet at the detection position. In this case, the CPU 301 determines that the sheet has passed through the detection position of the registration sensor 274 when the sensor output of the registration sensor 274 switches from OFF to ON and switches from ON to OFF again. Then, the CPU 301 increments the cumulative number of sheets conveyed by the pre-registration roller pair 186 by one. Similarly, the cumulative number of sheets can be calculated for the duplex sensor 275 and the duplex roller pair 185. As described above, in the present embodiment, the cumulative numbers of sheets conveyed by the pre-registration roller pair 186 and the duplex roller pair 185 are calculated based on the detection results of the registration sensor 274 and the duplex sensor 275, respectively.

Figure 3A:
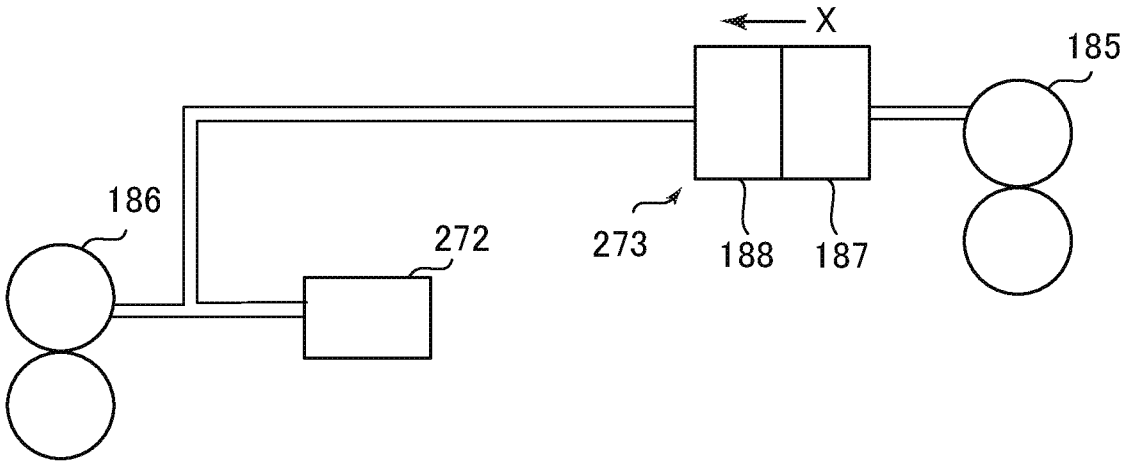
FIG. 3A is a diagram illustrating a clutch when a current is supplied according to the present embodiment.
Figure 3B:
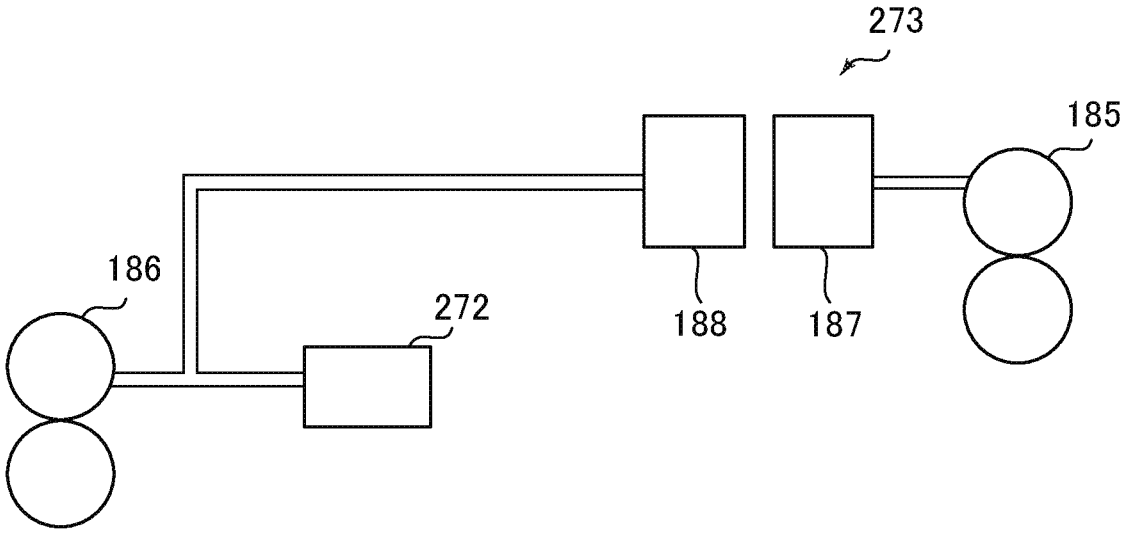
FIG. 3B is a diagram illustrating the clutch when the current supply is cut off.

Next, the driving of the roller pair driven by the pre-registration motor 272 as a driving unit according to the present embodiment will be described. FIGS. 3A and 3B are diagrams illustrating the driving of the pre-registration roller pair 186 and the duplex roller pair 185 according to the present embodiment. FIG. 3A is a diagram illustrating a case in which a current is supplied to the clutch 273, and FIG. 3B is a diagram illustrating a case in which the current supply to the clutch 273 is cut off. The clutch 273 as a drive force transmitting portion according to the present embodiment is an excitation operation type electromagnetic clutch, and when a current is supplied, as illustrated in FIG. 3A, a coil (not illustrated) inside the clutch 273 is excited by the current, and an electromagnetic force is generated in the arrow X direction. An armature 187 inside the clutch 273 is engaged with a rotor 188 by the electromagnetic force generated by current supply, so that the drive force of the pre-registration motor 272 is transmitted to the duplex roller pair 185, which becomes a transmission state. That is, the duplex roller pair 185 is rotated by the drive force of the pre-registration motor 272 when the armature 187 and the rotor 188 are engaged (transmission state).

When the current supply to the clutch 273 is cut off, as illustrated in FIG. 3B, electromagnetic force due to excitation of a coil (not illustrated) inside the clutch 273 is not generated, so that the engagement between the armature 187 and the rotor 188 is released. As a result, the drive force of the pre-registration motor 272 is not transmitted to the duplex roller pair 185, which becomes a non-transmission state. That is, when the engagement between the armature 187 and the rotor 188 is released (non-transmission state), the transmission of the drive force to the duplex roller pair 185 is cut off. As described above, the clutch 273 can be switched between the transmission state and the non-transmission state by supplying or cutting off the current to the clutch 273. In the present embodiment, it is noted that the pre-registration roller pair 186 is always connected to the pre-registration motor 272, and rotates with the driving of the pre-registration motor 272 regardless of whether the clutch 273 is in the transmission state or the non-transmission state. In the present embodiment, the conveyance speed of the sheet P by the duplex roller pair 185 is a second conveyance speed, and the conveyance speed of the sheet P by the pre-registration roller pair 186 is a first conveyance speed.

Figure 4A:
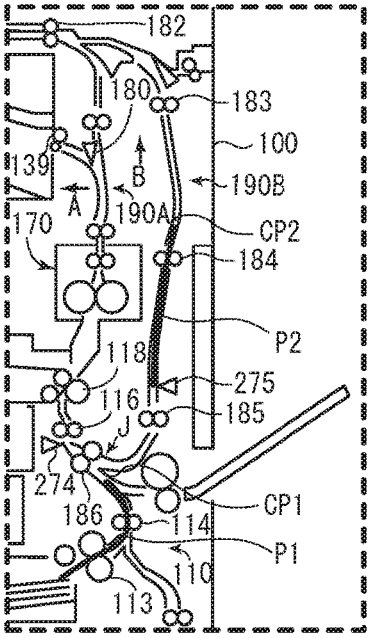
FIG. 4A is a section view for describing a duplex conveyance sequence according to the present embodiment.
Figure 4B:
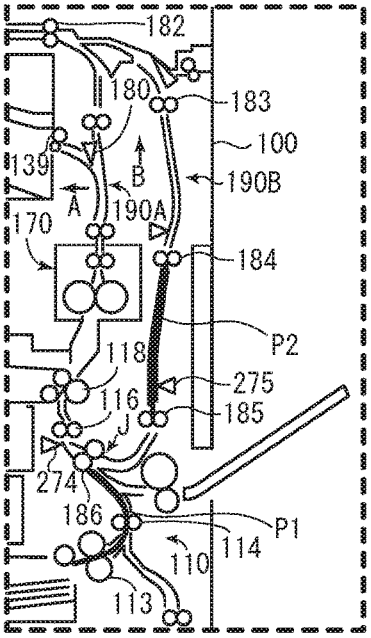
FIG. 4B is a section view illustrating a state in which the duplex conveyance sequence has progressed compared to FIG. 4A.
Figure 4C:
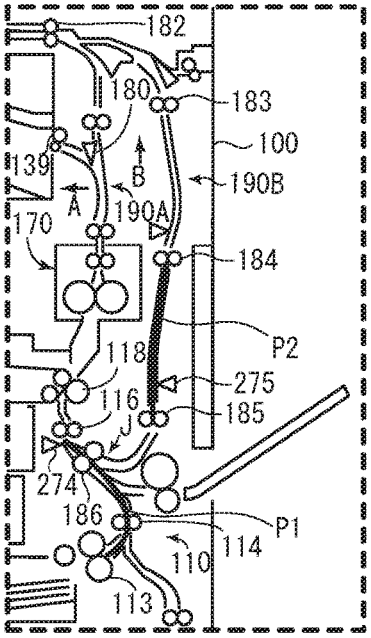
FIG. 4C is a section view illustrating a state in which the duplex conveyance sequence has progressed compared to FIG. 4B.
Figure 4D:
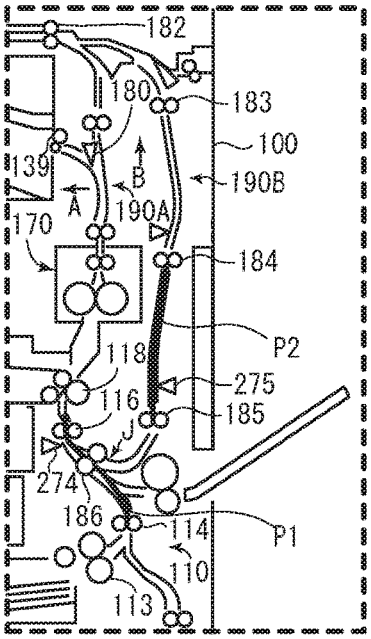
FIG. 4D is a section view illustrating a state in which the duplex conveyance sequence has progressed compared to FIG. 4C.
Figure 4E:
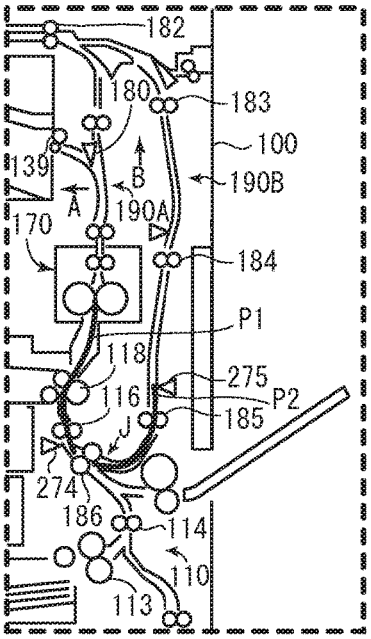
FIG. 4E is a section view illustrating a state in which the duplex conveyance sequence has progressed compared to FIG. 4D.
Figure 4F:
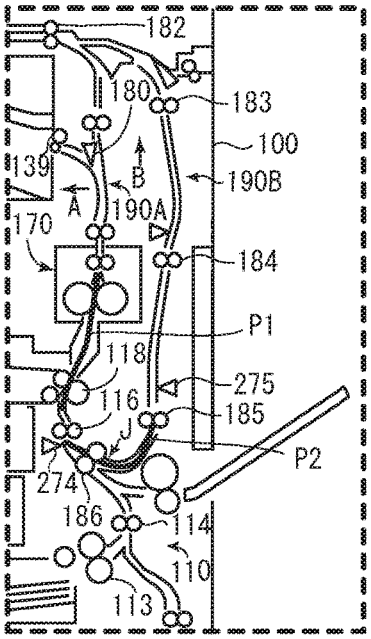
FIG. 4F is a section view illustrating a state in which the duplex conveyance sequence has progressed compared to FIG. 4E.
Figure 5:
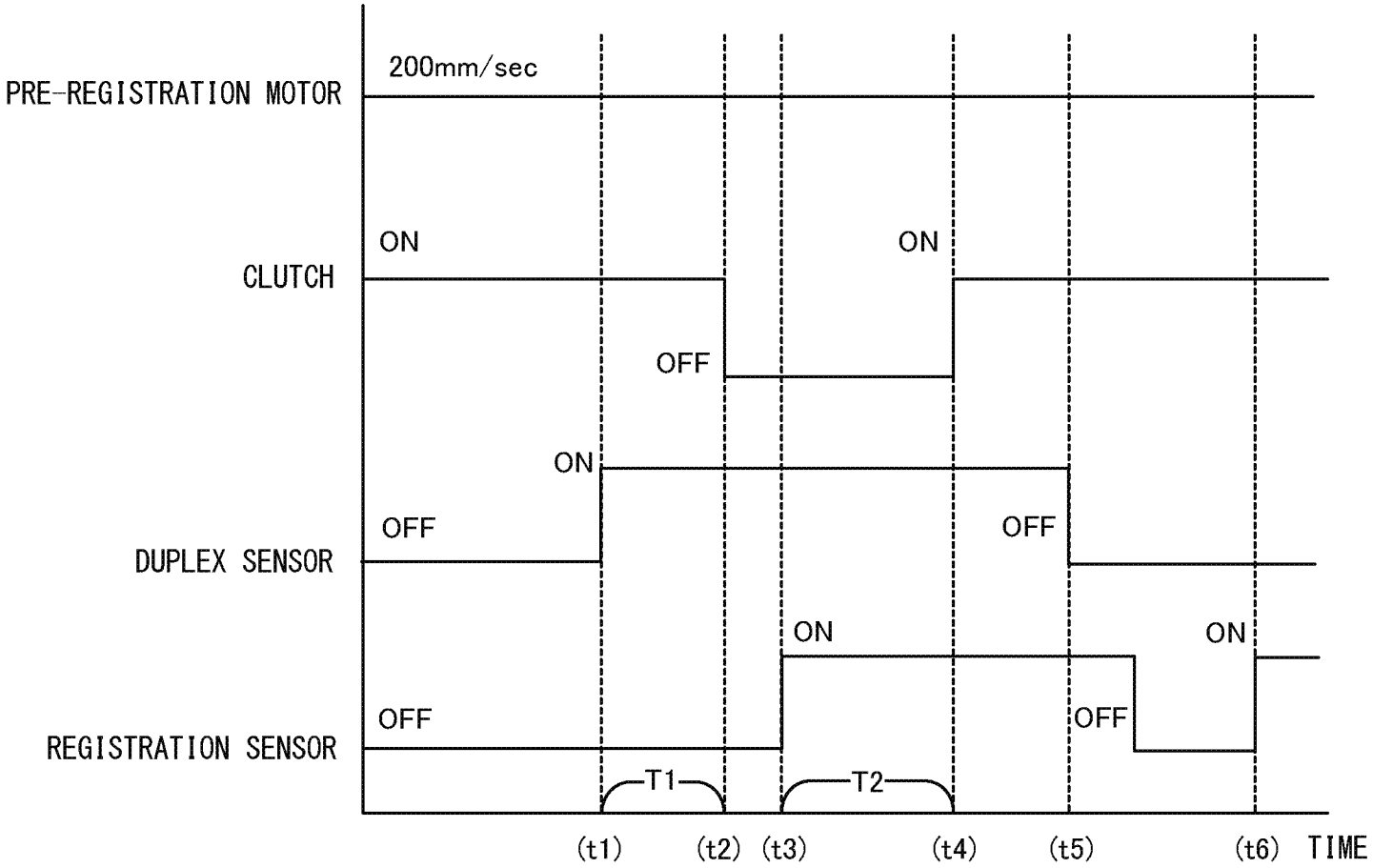
FIG. 5 is a time chart of the operation of the image forming apparatus during the execution of the duplex conveyance sequence according to the present embodiment.

Next, a duplex conveyance sequence for conveying the sheet P on two sides in the image forming apparatus 1 will be described with reference to FIGS. 4A to 5. FIGS. 4A to 4F are section views of main parts of the apparatus main body 100 for describing the progress of the duplex conveyance sequence. The duplex conveyance sequence of the sheet P in the image forming apparatus 1 proceeds in alphabetical order from FIGS. 4A to 4F. In FIGS. 4A to 4F, a sheet P1 fed from the sheet feed unit 110 is conveyed by the pre-registration roller pair 186, and a sheet P2 is conveyed from the duplex roller pair 185 toward the pre-registration roller pair 186. That is, the sheet fed from the sheet feed unit 110 toward the pre-registration roller pair 186 is illustrated as a sheet P1, and the sheet reversely conveyed by the reverse conveyance portion 190B is illustrated as a sheet P2. FIG. 5 is a time chart illustrating the operation of the image forming apparatus 1 in the duplex conveyance sequence of FIGS. 4A to 4F. In FIGS. 4A to 5, it is noted that description will be made on the assumption that the conveyance speeds of the sheet P1 and the sheet P2 are 200 mm/sec.

When the leading edge of the sheet P2 in the sheet conveyance direction, which is reversely conveyed toward the duplex roller pair 185, reaches the detection position of the duplex sensor 275, the sensor output of the duplex sensor 275 switches from OFF to ON (FIG. 5: t1). A second detection position according to the present embodiment is in a range in which the presence or absence of a sheet is detected by the duplex sensor 275, and is in a position where the sensor output of the duplex sensor 275 changes according to the detection result. Then, the CPU 301 calculates an arrival time T1 (msec) for the leading edge of the sheet P2 to reach the duplex roller pair 185 based on the conveyance speed of the sheet P2 and a distance Lr (mm) between the duplex sensor 275 and the duplex roller pair 185. It is noted that the arrival time T1 is obtained from the time from when the leading edge of the sheet P2 passes through the detection position of the duplex sensor 275 to when the sheet P2 reaches the duplex roller pair 185. The CPU 301 calculates (determines) the arrival time T1 using the following equation (1).

$$T1 = Lr \div 200 \times 1{,}000 \quad (1)$$

The CPU 301 causes the timer 276 to measure an elapsed time ET1 from the timing when the sensor output of the duplex sensor 275 switches from OFF to ON, and cuts off the current supply to the clutch 273 when the elapsed time ET1 becomes equal to or longer than the arrival time T1 (FIG. 5: t2). When the current supply to the clutch 273 is cut off, the drive force of the pre-registration motor 272 is not transmitted to the duplex roller pair 185, and as illustrated in FIG. 4B, the leading edge of the sheet P2 stops at the nip position of the duplex roller pair 185.

While the sheet P2 is being conveyed toward the duplex roller pair 185, the sheet P1 is fed from the sheet feed unit 110. As illustrated in FIG. 4C, the sheet P1 is conveyed via the sheet feed unit 110, the merging portion J, and the pre-registration roller pair 186 in this order. When the leading edge of the sheet P1 in the sheet conveyance direction reaches the detection position of the registration sensor 274, the sensor output of the registration sensor 274 changes from OFF to ON (FIG. 5: t3). A first detection position according to the present embodiment is in a range in which the presence or absence of a sheet is detected by the registration sensor 274, and is a position where the sensor output of the registration sensor 274 changes according to the detection result. At the timing when the leading edge of the sheet P1 reaches the detection position of the registration sensor 274, the CPU 301 calculates a drive restart timing t4 at which the clutch 273 is energized and the driving of the duplex roller pair 185 is restarted. It is noted that the drive restart timing t4 is a timing at which a drive restart time T2 from when the leading edge of the sheet P1 reaches the detection position of the registration sensor 274 to when the current is supplied to the clutch 273 has elapsed. The drive restart timing t4 is a timing at which the driving of the duplex roller pair 185 is restarted when the conveyance efficiency of the pre-registration roller pair 186 and the conveyance efficiency of the duplex roller pair 185 are the same, as described later. Assuming that the length of the sheet P1 in the sheet conveyance direction is L1 (mm) and the distance from the registration sensor 274 to the pre-registration roller pair 186 is Lp (mm), the CPU 301 calculates the drive restart time T2 using the following equation (2).

$$T2=(L1-Lp-30)\div 200\times 1{,}000 \quad (2)$$

Here, an equation for calculating the drive restart time T2 when the current is supplied to the clutch 273 at the timing when the trailing edge of the sheet P1 reaches a position 30 mm upstream from the pre-registration roller pair 186 in the sheet conveyance direction is shown.

It is noted that the sheet P1 is conveyed such that the image formed on the intermediate transfer belt 140 by the image forming units 10Y to 10K arrives at the secondary transfer unit 118 in time. Therefore, the drive restart timing t4 is not limited to the timing when the trailing edge of the sheet P1 reaches a position 30 mm upstream from the pre-registration roller pair 186. Any timing may be used as long as the sheet P2 can be conveyed such that an inter-sheet distance between the trailing edge of the sheet P1 and the leading edge of the sheet P2 is constant with reference to the conveyance timing of the sheet P1 by the pre-registration roller pair 186. Further, the detection position of the registration sensor 274 is not limited to the vicinity of the pre-registration roller pair 186. Therefore, a timing other than the timing when the leading edge of the sheet P1 reaches the detection position of the registration sensor 274 may be used as the conveyance timing of the sheet P1 by the pre-registration roller pair 186.

The CPU 301 causes the timer 276 to measure an elapsed time ET2 from the timing when the sensor output of the registration sensor 274 switches from OFF to ON. Then, when the elapsed time ET2 becomes equal to or longer than the drive restart time T2, the CPU 301 supplies a current to the clutch 273 (FIG. 5: t4). In the present embodiment, as illustrated in FIG. 4D, driving of the duplex roller pair 185 is restarted at the timing when the trailing edge of the sheet P1 reaches a position 30 mm upstream from the pre-registration roller pair 186. Then, as illustrated in FIG. 4E, when the sheet P2 is conveyed by the driving of the duplex roller pair 185 and the trailing edge of the sheet P2 passes through the detection position of the duplex sensor 275, the sensor output of the duplex sensor 275 changes from ON to OFF (FIG. 5: t5). Until the sheet P2 reaches the pre-registration roller pair 186, the trailing edge of the sheet P1 passes through the detection position of the registration sensor 274, so that the sensor output of the registration sensor 274 switches from ON to OFF (FIG. 5: t5 to t6). Thereafter, the sheet P2 is conveyed, and as illustrated in FIG. 4F, when the leading edge of the sheet P2 reaches the detection position of the registration sensor 274, the sensor output of the registration sensor 274 switches from OFF to ON (FIG. 5: t6). Thereafter, the sheet P2 is conveyed such that the image formed on the intermediate transfer belt 140 by the image forming units 10Y to 10K arrives at the secondary transfer unit 118 in time.

By the way, in the roller pair used to convey the sheet, the frictional force for conveying the sheet decreases due to the progress of deterioration such as abrasion of the roller surface. Further, the peripheral speed on the roller surface decreases. For this reason, even if the motor that drives the roller pair is driven at the same speed, as the deterioration of the rollers progresses, the conveyance speed of the sheet decreases, and the time required to convey one sheet increases. That is, as the deterioration of the rollers progresses, the conveyance efficiency of the sheet by the roller pair decreases. On the other hand, in the present embodiment, the driving speed of the motor that drives the roller pair is changed according to the deterioration condition of the roller, so that the conveyance speed of the sheet is kept constant.

Figure 6A:
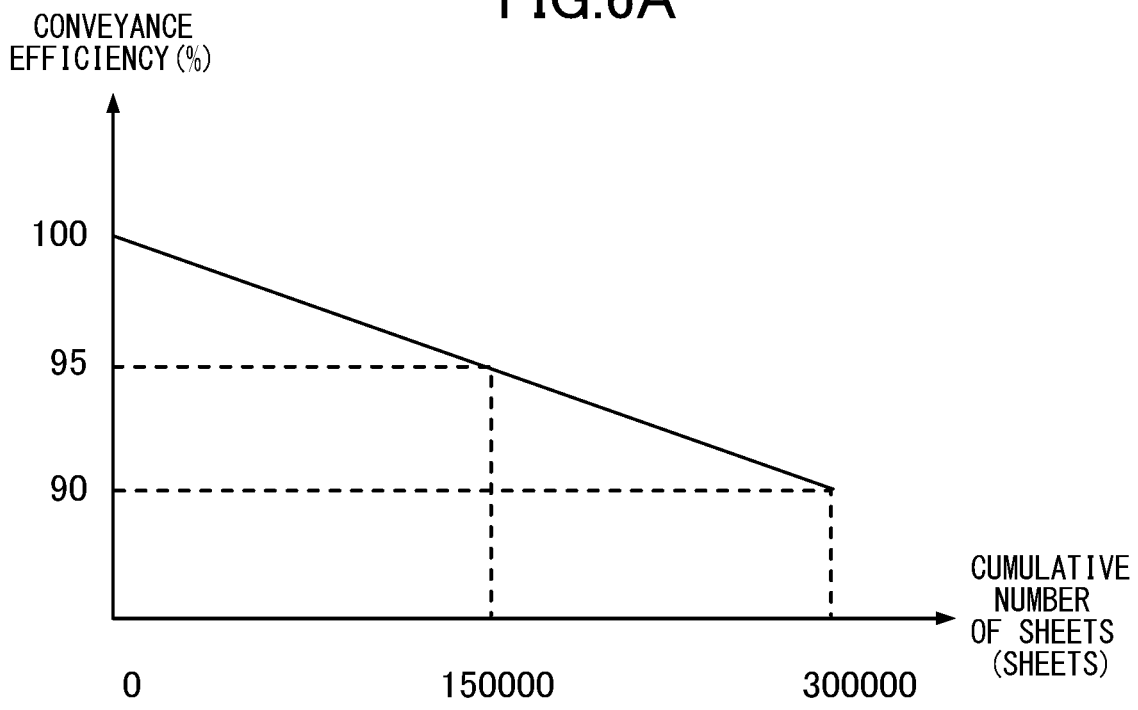
FIG. 6A is a graph illustrating the relationship between a cumulative number of sheets and a conveyance efficiency according to the present embodiment.

FIG. 6A is a graph illustrating the relationship between the cumulative number of sheets P conveyed by the roller pair (the number of sheets passed) and the conveyance efficiency of the sheet P by the roller pair. In FIG. 6A, it is assumed that the conveyance efficiency when the cumulative number of sheets conveyed by the roller pair is 0, that is, when the roller pair is new, is 100%. As illustrated in FIG. 6A, when the cumulative number of sheets conveyed by the roller pair is 150,000, the conveyance efficiency is 95%, and when the cumulative number of sheets conveyed by the roller pair is 300,000, the conveyance efficiency is 90%. As the deterioration of the roller pair progresses, the conveyance efficiency also decreases. When the conveyance efficiency decreases, the time required to convey the sheet P increases. Therefore, in order to maintain the productivity of the conveyance operation of the sheet P in the image forming apparatus 1, the time required to convey the sheet P needs to be about the same as when the conveyance efficiency is high. In other words, in order to keep the conveyance speed of the sheet P by the roller pair constant, it is necessary to increase the driving speed of the roller pair whose conveyance efficiency has decreased with respect to a driving speed of a new roller pair.

Figure 6B:
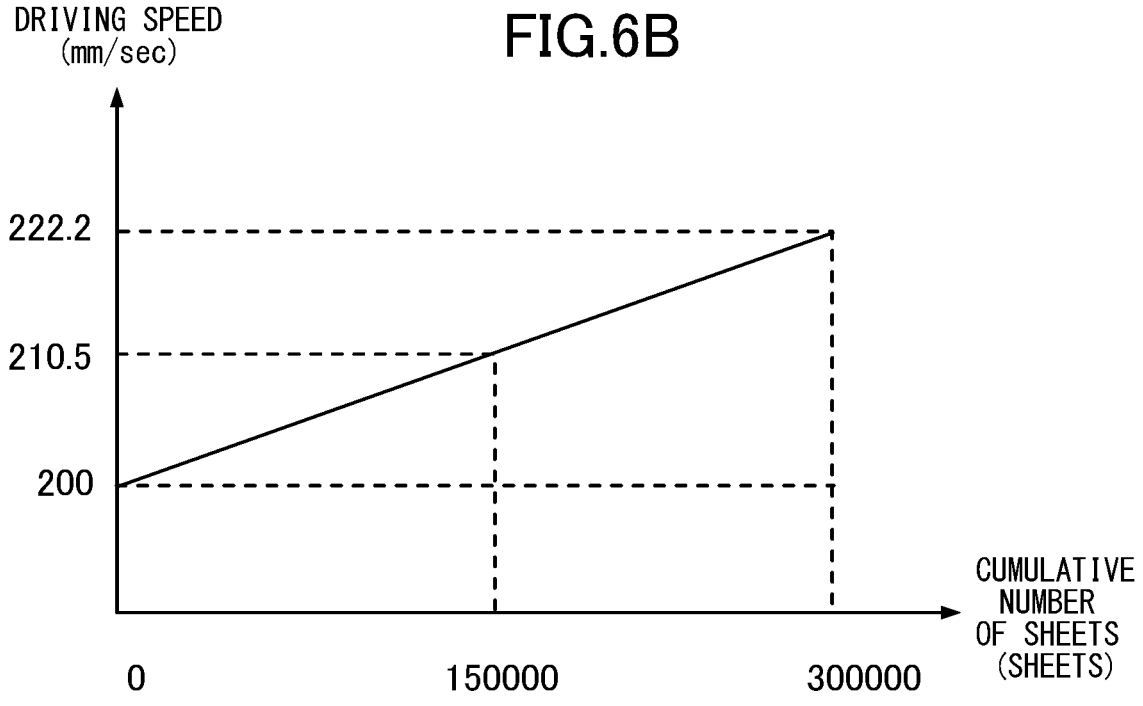
FIG. 6B is a graph illustrating the relationship between the cumulative number of sheets and a conveyance speed.

FIG. 6B is a graph illustrating a control mode of the driving speed of the motor which is performed to keep the conveyance speed of the sheet P by the roller pair having the characteristics illustrated in FIG. 6A at 200 mm/sec. In the present embodiment, it is noted that the driving speed of the motor is expressed by the conveyance speed of the sheet P by the roller pair assuming that the conveyance efficiency of the roller pair is 100%. As illustrated in FIG. 6A, when the roller pair is new, the conveyance efficiency is 100%. Therefore, in order to convey the sheet P at 200 mm/sec, the driving speed of the motor is controlled to 200 mm/sec. Further, when the cumulative number of sheets conveyed by the roller pair is 150,000, the conveyance efficiency is 95%. Therefore, in order to convey the sheet P at 200 mm/sec, the driving speed of the motor is controlled to 200 (mm/sec)×100÷95=210.5 (mm/sec). Further, when the cumulative number of sheets conveyed by the roller pair is 300,000, the conveyance efficiency is 90%. Therefore, in order to convey the sheet P at 200 mm/sec, the driving speed of the motor is controlled to 200 (mm/sec)×100÷90=222.2 (mm/sec).

As described above, in order to keep the conveyance speed of the sheet P by the roller pair constant, in the present embodiment, the driving speed of the motor is changed according to the progress of the deterioration of the roller. In the present embodiment, it is noted that the driving speed of the motor can be changed according to the cumulative number of sheets conveyed by the roller, but the driving speed of the motor may be changed using other methods. For example, first, passage of the sheet P in a predetermined conveyance section is detected based on a sensor output provided on the conveyance route of the sheet P. Next, the time required for the sheet to pass through the detection position is calculated based on the information of the time when the sensor output has changed, the conveyance efficiency is obtained based on the calculated time and the length of the sheet P, and the driving speed of the motor may be changed according to the obtained conveyance efficiency.

As described with reference to FIGS. 3A and 3B, when the clutch 273 is in the transmission state, the duplex roller pair 185 rotates by the drive force of the pre-registration motor 272 which is also a drive source of the pre-registration roller pair 186. In the image forming apparatus 1, the pre-registration roller pair 186 is a roller pair through which the sheet P passes when performing simplex printing and two-side printing, whereas the duplex roller pair 185 is a roller pair through which the sheet P passes only during two-side printing. Therefore, the pre-registration roller pair 186 tends to deteriorate more easily than the duplex roller pair 185, and the deterioration conditions of the rollers in the pre-registration roller pair 186 and the duplex roller pair 185 are often different. When the deterioration conditions of the two rollers sharing the motor of the drive source are different, the driving speed of the pre-registration motor 272 as the drive source needs to be adjusted according to the deterioration condition of either the pre-registration roller pair 186 or the duplex roller pair 185. In the present embodiment, the driving speed of the pre-registration motor 272 is controlled based on the deterioration condition of the pre-registration roller pair 186. Next, a difference in the conveyance speed of the sheet P in the pre-registration roller pair 186 and the duplex roller pair 185 will be described with reference to FIGS. 7A to 7C. In the description of FIGS. 7A to 7C, it is noted that the conveyance speed of the sheet P by the pre-registration roller pair 186 when it is new is 200 mm/sec. Further, in the description of FIGS. 7A to 7C, a case where the driving speed of the pre-registration motor 272 is controlled such that the speed of the pre-registration roller pair 186 becomes 200 mm/sec will be described.

FIG. 7A is a table illustrating the conveyance speed of the sheet P in the pre-registration roller pair 186 and the duplex roller pair 185 in a state in which the pre-registration roller pair 186 is new (when the cumulative number of sheets conveyed is 0) and the duplex roller pair 185 is new (when the cumulative number of sheets conveyed is 0). In the case of a new product, the conveyance efficiencies of the pre-registration roller pair 186 and the duplex roller pair 185 are 100%.

A first state according to the present embodiment refers to a state in which the conveyance efficiency of the pre-registration roller pair 186 and the conveyance efficiency of the duplex roller pair 185 are the same (for example, the state of FIG. 7A). Further, a first efficiency of the present embodiment is the conveyance efficiency of the pre-registration roller pair 186 in the first state. Further, a second efficiency of the present embodiment is the conveyance efficiency of the duplex roller pair 185 in the first state. Then, the driving speed of the pre-registration motor 272 is controlled to 200 mm/sec in order to make the conveyance speed of the sheet P by the pre-registration roller pair 186 be 200 mm/sec (FIG. 6B). The conveyance speed of the sheet P by the duplex roller pair 185 can be obtained by (driving speed of the pre-registration motor 272)×(conveyance efficiency of the duplex roller pair 185)÷100. Therefore, the conveyance speed of the sheet P by the duplex roller pair 185 is 200 (mm/sec)×100÷100=200 (mm/sec). Therefore, when the cumulative numbers of sheets conveyed by the duplex roller pair 185 and the pre-registration roller pair 186 are the same, the conveyance speeds of the sheet Pin the duplex roller pair 185 and the pre-registration roller pair 186 are also the same. That is, when the conveyance efficiencies of the sheet P in the duplex roller pair 185 and the pre-registration roller pair 186 are the same, the conveyance speeds of the sheet P in the duplex roller pair 185 and the pre-registration roller pair 186 are also the same. In other words, the first state according to the present embodiment is also a state in which the cumulative number of sheets conveyed by the pre-registration roller pair 186 and the cumulative number of sheets conveyed by the duplex roller pair 185 are the same.

FIG. 7B is a table illustrating the conveyance speed of the sheet P in the pre-registration roller pair 186 and the duplex roller pair 185 in a state in which the cumulative number of sheets conveyed by the pre-registration roller pair 186 is 300,000 and the cumulative number of sheets conveyed by the duplex roller pair 185 is 150,000. When the cumulative number of sheets conveyed is 300,000, the conveyance efficiency of the pre-registration roller pair 186 is 90% (FIG. 6A). Then, the driving speed of the pre-registration motor 272 is controlled to 222.2 mm/sec in order to keep the conveyance speed of the sheet P by the pre-registration roller pair 186 at 200 mm/sec (FIG. 6B). Meanwhile, when the cumulative number of sheets conveyed is 150,000, the conveyance efficiency of the duplex roller pair 185 is 95%. The conveyance speed of the sheet P by the duplex roller pair 185 is obtained by (driving speed of the pre-registration motor 272)×(conveyance efficiency of the duplex roller pair 185)÷100. That is, the conveyance speed of the sheet P by the duplex roller pair 185 is 222.2 (mm/sec)×95÷100=211.1 (mm/sec).

A second state according to the present embodiment refers to a state in which the amount of reduction in the conveyance efficiency of the duplex roller pair 185 is smaller than the amount of reduction in the conveyance efficiency of the pre-registration roller pair 186 (for example, the state of FIG. 7B). A third efficiency of the present embodiment is the conveyance efficiency of the pre-registration roller pair 186 when not in the first state. Further, a fourth efficiency of the present embodiment is the conveyance efficiency of the duplex roller pair 185 when not in the first state. As illustrated in FIG. 7B, when the cumulative number of sheets conveyed by the pre-registration roller pairs 186 is larger than that of the duplex roller pairs 185, the conveyance efficiency of the pre-registration roller pairs 186 is lower than the conveyance efficiency of the duplex roller pairs 185. That is, the second state according to the present embodiment is also a state in which the cumulative number of sheets conveyed by the duplex roller pair 185 is smaller than the cumulative number of sheets conveyed by the pre-registration roller pair 186. Further, when the conveyance efficiency of the pre-registration roller pair 186 is lower than that of the duplex roller pair 185, the conveyance speed of the sheet P in the pre-registration roller pair 186 is smaller than the conveyance speed of the sheet P in the duplex roller pair 185.

In the present embodiment, when the cumulative number of sheets conveyed by the roller pair reaches 300,000, the roller pair is replaced with a new roller pair. Here, description on FIG. 7C will be made on the assumption that the cumulative number of sheets conveyed by the pre-registration roller pair 186 has reached 300,000 and the pre-registration roller pair 186 has been replaced with new one. FIG. 7C is a table illustrating the conveyance speed of the sheet P in the pre-registration roller pair 186 and the duplex roller pair 185 in a state in which the cumulative number of sheets conveyed by the pre-registration roller pair 186 is 0 and the cumulative number of sheets conveyed by the duplex roller pair 185 is 150,000. The conveyance efficiency of the pre-registration roller pair 186 when it is new is 100% (FIG. 6A). Then, the driving speed of the pre-registration motor 272 is controlled to 200 mm/sec in order to keep the conveyance speed of the sheet P by the pre-registration roller pair 186 at 200 mm/sec (FIG. 6B). Meanwhile, when the cumulative number of sheets conveyed is 150,000, the conveyance efficiency of the duplex roller pair 185 is 95%. The conveyance speed of the sheet P by the duplex roller pair 185 can be obtained by (driving speed of the pre-registration motor 272)×(conveyance efficiency of the duplex roller pair 185)÷100. That is, the conveyance speed of the sheet P by the duplex roller pair 185 is 200 (mm/sec)×95÷100=190 (mm/sec).

A third state according to the present embodiment refers to a state in which the amount of reduction in the conveyance efficiency of the duplex roller pair 185 is greater than the amount of reduction in the conveyance efficiency of the pre-registration roller pair 186 (the state of FIG. 7C). As described above, when the cumulative number of sheets conveyed by the pre-registration roller pair 186 is smaller than that of the duplex roller pairs 185, the conveyance efficiency of the pre-registration roller pair 186 is higher than the conveyance efficiency of the duplex roller pair 185. That is, the third state according to the present embodiment is also a state in which the cumulative number of sheets conveyed by the duplex roller pair 185 is larger than the cumulative number of sheets conveyed by the pre-registration roller pair 186. Further, when the conveyance efficiency of the pre-registration roller pair 186 is higher than that of the duplex roller pair 185, the conveyance speed of the sheet P in the pre-registration roller pair 186 is greater than the conveyance speed of the sheet P in the duplex roller pair 185.

Next, the effect of the difference in the conveyance speed of the sheet P in the pre-registration roller pair 186 and the duplex roller pair 185 will be described with reference to FIGS. 8A to 8D. In FIGS. 8A to 8D, after the sheet P1 is fed from the sheet feed unit 110, changes in the inter-sheet distance between the sheets P1 and P2 when the sheet P2 is conveyed to the pre-registration roller pair 186 are illustrated. In FIGS. 8A to 8D, when the cumulative number of sheets conveyed by the roller pair is 300,000, "end-of-life" is indicated, when it is 150,000, "middle-of-life" is indicated, and when it is 0, "new" is indicated. In addition, in FIGS. 8A to 8D, description will be made on the assumption that the distance from the duplex roller pair 185 to the pre-registration roller pair 186 is 35 mm. Further, in FIGS. 8A to 8D, description will be made on the assumption that the distance from the pre-registration roller pair 186 to the trailing edge of the sheet P1 in the direction of conveyance at the timing when the driving of the duplex roller pair 185 is started (restarted) is 30 mm.

Figure 8A:
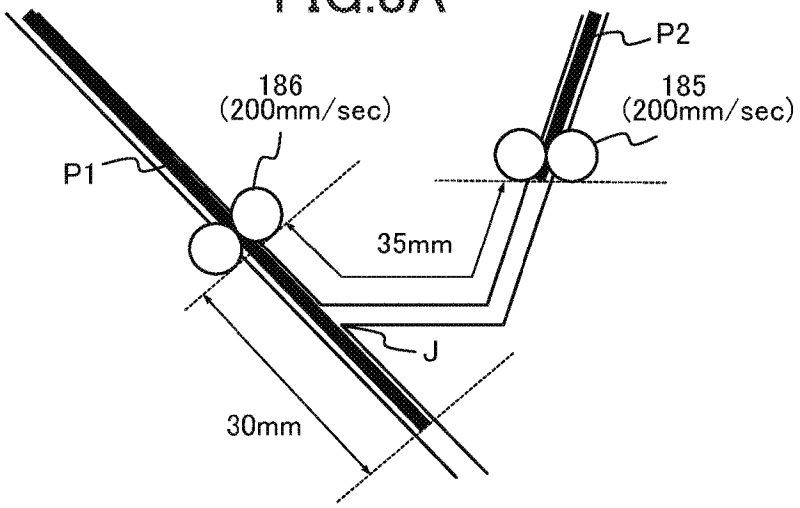
FIG. 8A is a diagram illustrating a state in which a sheet P2 is stopped.

FIG. 8A illustrates the positional relationship between the sheets P1 and P2 at the drive restart timing of the duplex roller pair 185. As illustrated in FIG. 8A, at the timing when the driving of the duplex roller pair 185 is started by the engagement of the clutch 273, the trailing edge of the sheet P1 in the direction of conveyance is located at a position 30 mm upstream from the pre-registration roller pair 186 in the direction of conveyance of the sheet P1. Meanwhile, the leading edge of the sheet P2 in the direction of conveyance is located at the position of the duplex roller pair 185, that is, at a position 35 mm upstream from the pre-registration roller pair 186 in the direction of conveyance of the sheet P2.

Figure 8B:
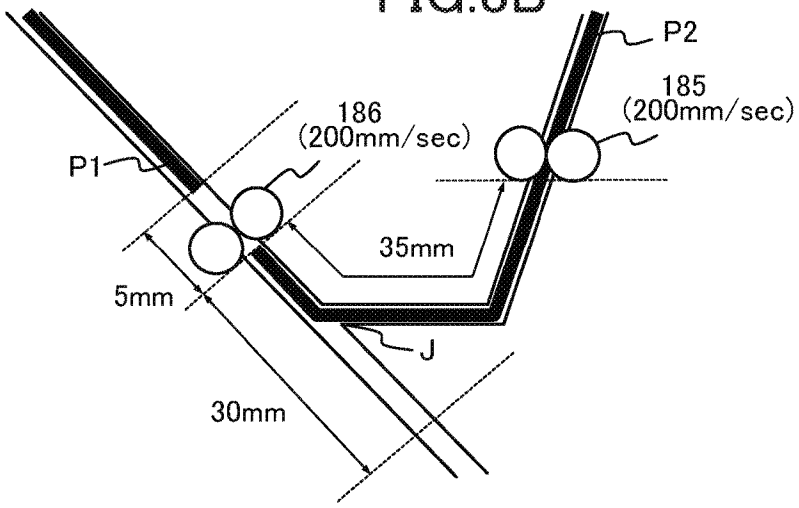
FIG. 8B is a diagram illustrating a state in which the distance between a sheet P1 and the sheet P2 is 5 mm.
Figure 8C:
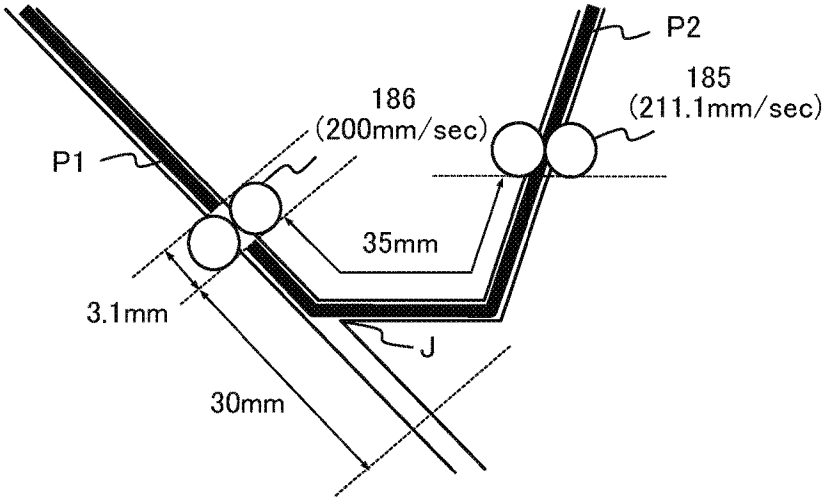
FIG. 8C is a diagram illustrating a state in which the distance between the sheet P1 and the sheet P2 is 3.1 mm.

FIGS. 8B to 8C illustrate the positional relationship between the sheet P1 and the sheet P2 when the leading edge of the sheet P2 reaches the pre-registration roller pair 186 in direction of conveyance of the sheet P. FIG. 8B illustrates the positional relationship between the sheet P1 and the sheet P2 when both the pre-registration roller pair 186 and the duplex roller pair 185 are new. When both the pre-registration roller pair 186 and the duplex roller pair 185 are new, the conveyance speed of the sheet P is 200 mm/sec in any of the roller pairs as described with reference to FIG. 7A. Therefore, the sheet P1 and the sheet P2 are conveyed by 35 mm from the timing when the clutch 273 is in the transmission state and the driving of the duplex roller pair 185 is started until the leading edge of the sheet P2 in the direction of conveyance reaches the pre-registration roller pair 186. Therefore, when the leading edge of the sheet P2 in the direction of conveyance reaches the pre-registration roller pair 186, the trailing edge of the sheet P1 in the direction of conveyance is located at a position 5 mm downstream from the pre-registration roller pair 186. In the present embodiment, it is noted that the sheet P is conveyed such that the inter-sheet distance between the sheets P1 and P2 is always 5 mm, but the inter-sheet distance is not limited to 5 mm.

FIG. 8C illustrates the positional relationship between the sheet P1 and the sheet P2 when the pre-registration roller pair 186 is in the end-of-life and the duplex roller pair 185 is in the middle-of-life. In this case, the conveyance speed of the sheet P by the pre-registration roller pair 186 is 200 mm/sec, and the conveyance speed of the sheet P by the duplex roller pair 185 is 211.1 mm/sec (FIG. 7B). Therefore, before the duplex roller pair 185 conveys the sheet P2 by 35 mm, the pre-registration roller pair 186 conveys the sheet P1 by 35 (mm)×200 (mm/sec)÷211.1 (mm/sec)=33.15 (mm). That is, the sheet P1 is conveyed by the pre-registration roller pair 186 by 33.15 mm before the leading edge of the sheet P2 in the direction of conveyance reaches the pre-registration roller pair 186. Due to the conveyance of the sheet P1 by the pre-registration roller pair 186, the trailing edge of the sheet P1 in the direction of conveyance is located at a position 3.1 mm downstream from the pre-registration roller pair 186 in the direction of conveyance. As described above, when the conveyance efficiency of the pre-registration roller pair 186 is lower than that of the duplex roller pair 185, the leading edge of the sheet P1 and the trailing edge of the sheet P2 are closer to each other than when the pre-registration roller pair 186 and the duplex roller pair 185 are new. When the leading edge of the sheet P1 and the trailing edge of the sheet P2 are close to each other, that is, when the inter-sheet distance between the sheet P1 and the sheet P2 is short, the sheet P1 and the sheet P2 are likely to collide with each other, and thus a jam is likely to occur.

Figure 8D:
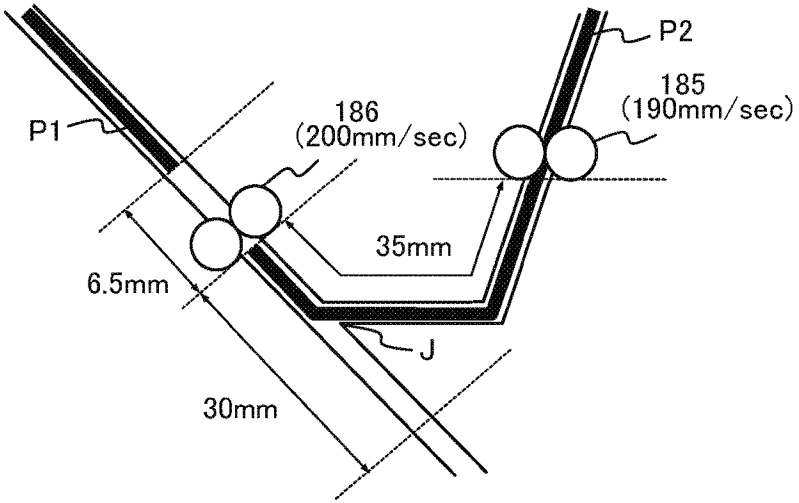
FIG. 8D is a diagram illustrating a state in which the distance between the sheet P1 and the sheet P2 is 6.5 mm.

FIG. 8D illustrates the positional relationship between the sheet P1 and the sheet P2 when the pre-registration roller pair 186 is new and the duplex roller pair 185 is in the middle-of-life. In this case, the conveyance speed of the sheet P by the pre-registration roller pair 186 is 200 mm/sec, and the conveyance speed of the sheet P by the duplex roller pair 185 is 190 mm/sec (FIG. 7C). Therefore, before the duplex roller pair 185 conveys the sheet P2 by 35 mm, the sheet P1 is conveyed by the pre-registration roller pair 186 by 35 (mm)×200 (mm/sec) 190 (mm/sec)=36.8 (mm). That is, the sheet P1 is conveyed by the pre-registration roller pair 186 by 36.8 mm before the leading edge of the sheet P2 in the direction of conveyance reaches the pre-registration roller pair 186. Due to the conveyance of the sheet P1 by the pre-registration roller pair 186, the trailing edge of the sheet P1 in the direction of conveyance is located at a position 6.8 mm downstream from the pre-registration roller pair 186 in the direction of conveyance. As described above, when the conveyance efficiency of the pre-registration roller pair 186 is higher than that of the duplex roller pair 185, the leading edge of the sheet P1 and the trailing edge of the sheet P2 are farther apart from each other than when the pre-registration roller pair 186 and the duplex roller pair 185 are new. When the leading edge of the sheet P1 and the trailing edge of the sheet P2 are far apart from each other, that is, when the inter-sheet distance between the sheet P1 and the sheet P2 is long, a jam is likely to occur due to the delay of the sheet P2. It is noted that the jam due to the delay of the sheet refers to a state in which the image forming apparatus 1 determines that an abnormality has occurred in the conveyance of a sheet based on the fact that the sheet is not detected at a timing when the sheet should be detected by a sensor such as the registration sensor 274.

As described with reference to FIGS. 8A to 8D, when the difference occurs in the conveyance speed of the sheet between the pre-registration roller pair 186 and the duplex roller pair 185, a jam is likely to occur in the image forming apparatus 1. On the other hand, in the present embodiment, the drive restart timing t4 of the duplex roller pair 185 is changed in the duplex conveyance sequence (FIGS. 4A to 5). Next, a manner of changing the drive restart timing t4 according to the present embodiment will be described with reference to FIGS. 9A and 9B. Further, also in FIGS. 9A and 9B, like FIGS. 8A to 8D, it is assumed that the distance from the duplex roller pair 185 to the pre-registration roller pair 186 is 35 mm. Further, in the description of FIGS. 9A and 9B, the driving speed of the pre-registration motor 272 is set such that the conveyance speed of the sheet conveyed by the pre-registration roller pair 186 is constant (200 mm/sec).

Figure 9A:
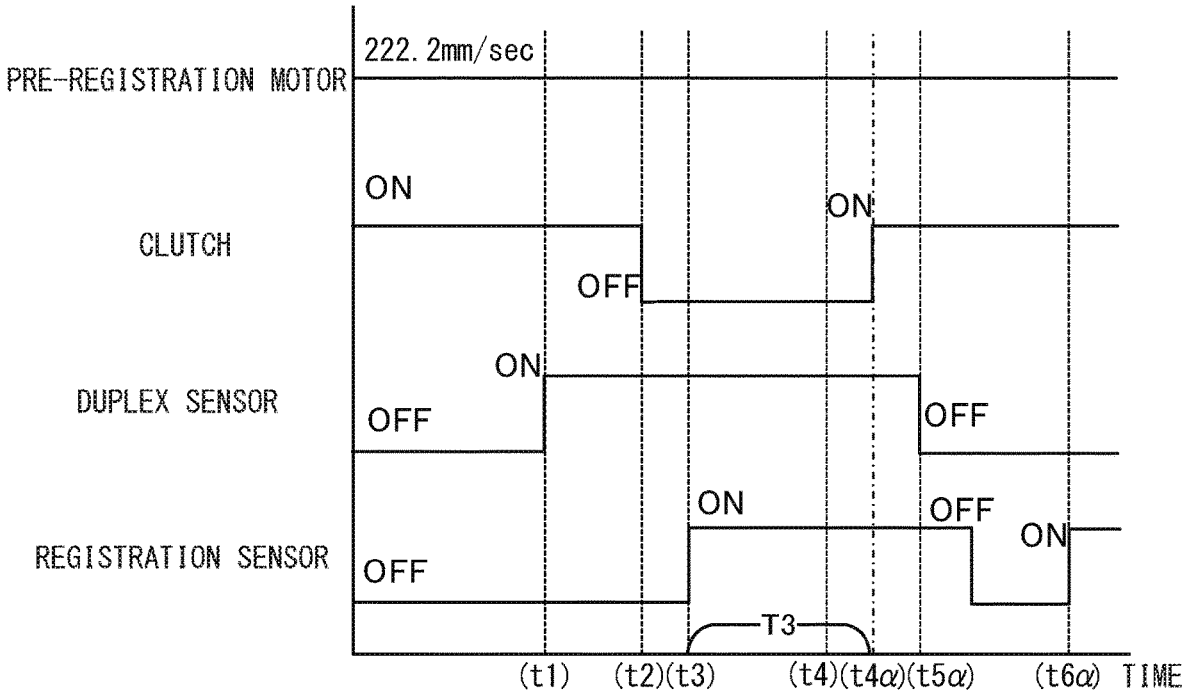
FIG. 9A is a time chart illustrating a duplex conveyance sequence in a second mode according to the present embodiment.

FIG. 9A is a time chart illustrating the operation of the image forming apparatus 1 in the duplex conveyance sequence when the pre-registration roller pair 186 is in the end-of-life and the duplex roller pair 185 is in the middle-of-life. In FIG. 9A, the drive restart timing of the duplex roller pair 185 when both the pre-registration roller pair 186 and the duplex roller pair 185 are new (the cumulative number of sheets conveyed is 0) is indicated as t4. A first timing according to the present embodiment is the drive restart timing t4 when the conveyance efficiency of the pre-registration roller pair 186 and the conveyance efficiency of the duplex roller pair 185 are the same. Here, assuming that the sheet P2 is conveyed by the duplex roller pair 185 at t4, at the timing when the sheet P2 reaches the pre-registration roller pair 186, the inter-sheet distance between the sheet P1 and the sheet P2 becomes short (FIG. 8C).

On the other hand, in the present embodiment, first, the conveyance speed of the sheet P2 by the duplex roller pair 185 is calculated based on the conveyance efficiency of the pre-registration roller pair 186 and the conveyance efficiency of the duplex roller pair 185. Next, a time required for the sheet P2 to reach the pre-registration roller pair 186 is calculated based on the conveyance speed of the sheet P2. The driving speed of the pre-registration motor 272 is set to 222.2 mm/sec in order to make the conveyance speed of the sheet conveyed by the pre-registration roller pair 186 be 200 mm/sec (FIG. 9A). In this case, the conveyance speed of the sheet P2 by the duplex roller pair 185 is 211.1 mm/sec (see FIG. 7B). Therefore, the time required for the sheet P2 to reach the pre-registration roller pair 186 from the duplex roller pair 185 is 35 (mm)÷211.1 (mm/sec)×1,000=166 msec. Further, in the case of a new product, the time required for the sheet P2 to reach the pre-registration roller pair 186 from the duplex roller pair 185 is 35 (mm)÷200 (mm/sec)× 1,000=175 msec. As described above, when the pre-registration roller pair 186 is in the end-of-life and the duplex roller pair 185 is in the middle-of-life, the timing at which the sheet P2 reaches the pre-registration roller pair 186 is 9 msec earlier than when the two roller pairs are new. In other words, in order to keep the inter-sheet distance between the sheet P1 and the sheet P2 at 5 mm at the timing when the sheet P2 reaches the pre-registration roller pair 186, the drive restart timing of the duplex roller pair 185 may be set to t4α which is delayed by 9 msec compared to when the roller pairs are new (t4). In other words, a second timing according to the present embodiment is a drive restart timing t4α later than the first timing (t4, see FIG. 5) when the conveyance efficiency of and the cumulative number of sheets conveyed by the pre-registration roller pair 186 and the conveyance efficiency of and the cumulative number of sheets conveyed by the duplex roller pair 185 are the same. As described above, in a case where the second conveyance speed is greater than the first conveyance speed, when the drive restart timing is made later than when the first conveyance speed and the second conveyance speed are the same, the inter-sheet distance between the sheet P1 and the sheet P2 can be kept constant.

Figure 9B:
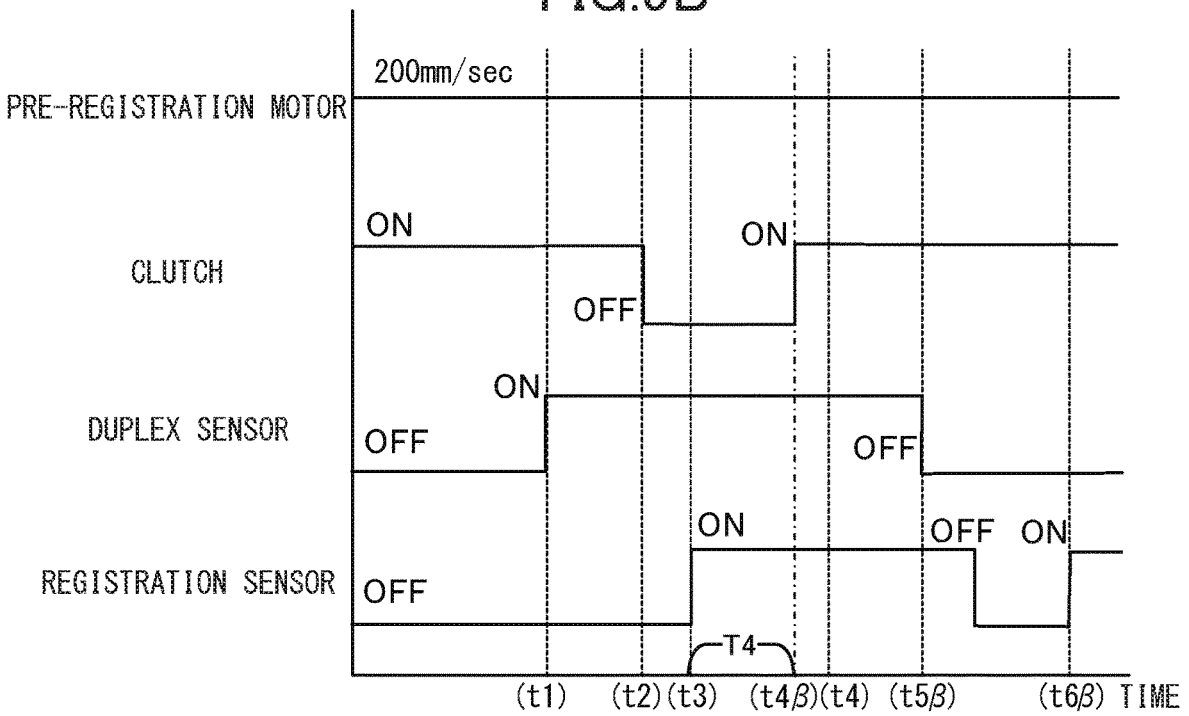
FIG. 9B is a time chart illustrating a duplex conveyance sequence in a third mode.

FIG. 9B is a time chart illustrating the operation of the image forming apparatus 1 in the duplex conveyance sequence when the pre-registration roller pair 186 is new and the duplex roller pair 185 is in the middle-of-life. In FIG. 9B, the drive restart timing when both the pre-registration roller pair 186 and the duplex roller pair 185 are new (the cumulative number of sheets conveyed is 0) is indicated as t4. In FIG. 9B, the conveyance speed of the sheet P2 by the duplex roller pair 185 becomes slower than the conveyance speed of the sheet by the pre-registration roller pair 186. Here, assuming that the sheet P2 is conveyed by the duplex roller pair 185 at t4, at the timing when the sheet P2 reaches the pre-registration roller pair 186, the inter-sheet distance between the sheet P1 and the sheet P2 becomes long (FIG. 8D).

On the other hand, in the present embodiment, the drive restart timing is advanced to t4β such that the inter-sheet distance between the sheet P1 and the sheet P2 at the timing when the sheet P2 reaches the pre-registration roller pair 186 becomes 5 mm. (FIG. 9B). The driving speed of the pre-registration motor 272 is set to 200 mm/sec in order to make the conveyance speed of the sheet conveyed by the pre-registration roller pair 186 be 200 mm/sec (FIG. 9B). In this case, the conveyance speed of the sheet P2 by the duplex roller pair 185 is 190 mm/sec (see FIG. 7C). Therefore, the time required for the sheet P2 to reach the pre-registration roller pair 186 from the duplex roller pair 185 is 35 (mm) ÷190 (mm/sec)×1,000=184 msec. In the case of a new product, the time required for the sheet P2 to reach the pre-registration roller pair 186 from the duplex roller pair 185 is 35 (mm)÷200 (mm/sec)×1,000=175 msec. As described above, when the pre-registration roller pair 186 is new and the duplex roller pair 185 is in the middle-of-life, the timing at which the sheet P2 reaches the pre-registration roller pair 186 is delayed by 9 msec from the time when the two roller pairs are new. In other words, in order to keep the inter-sheet distance between the sheet P1 and the sheet P2 at 5 mm at the timing when the sheet P2 reaches the pre-registration roller pair 186, the drive restart timing of the duplex roller pair 185 may be set to t4β which is advanced by 9 msec compared to when the roller pairs are new (t4). In other words, a third timing according to the present embodiment is a drive restart timing t4β earlier than the first timing (t4, see FIG. 5) when the conveyance efficiency of and the cumulative number of sheets conveyed by the pre-registration roller pair 186 and the conveyance efficiency of and the cumulative number of sheets conveyed by the duplex roller pair 185 are the same. As described above, in a case where the second conveyance speed is smaller than the first conveyance speed, when the drive restart timing is made earlier than when the first conveyance speed and the second conveyance speed are the same, the inter-sheet distance between the sheet P1 and the sheet P2 can be kept constant.

As described above, in the present embodiment, the timing at which the conveyance of the sheet from the duplex roller pair 185 to the pre-registration roller pair 186 is restarted is changed according to the difference in the conveyance speed of the sheet in the pre-registration roller pair 186 and the duplex roller pair 185. Thereby, since the inter-sheet distance between the sheet P2 and the sheet P1 at the timing when the sheet P2 reaches the pre-registration roller pair 186 can be kept constant, it is possible to reduce the occurrence of a jam caused by a change in the inter-sheet distance.

Figure 10:
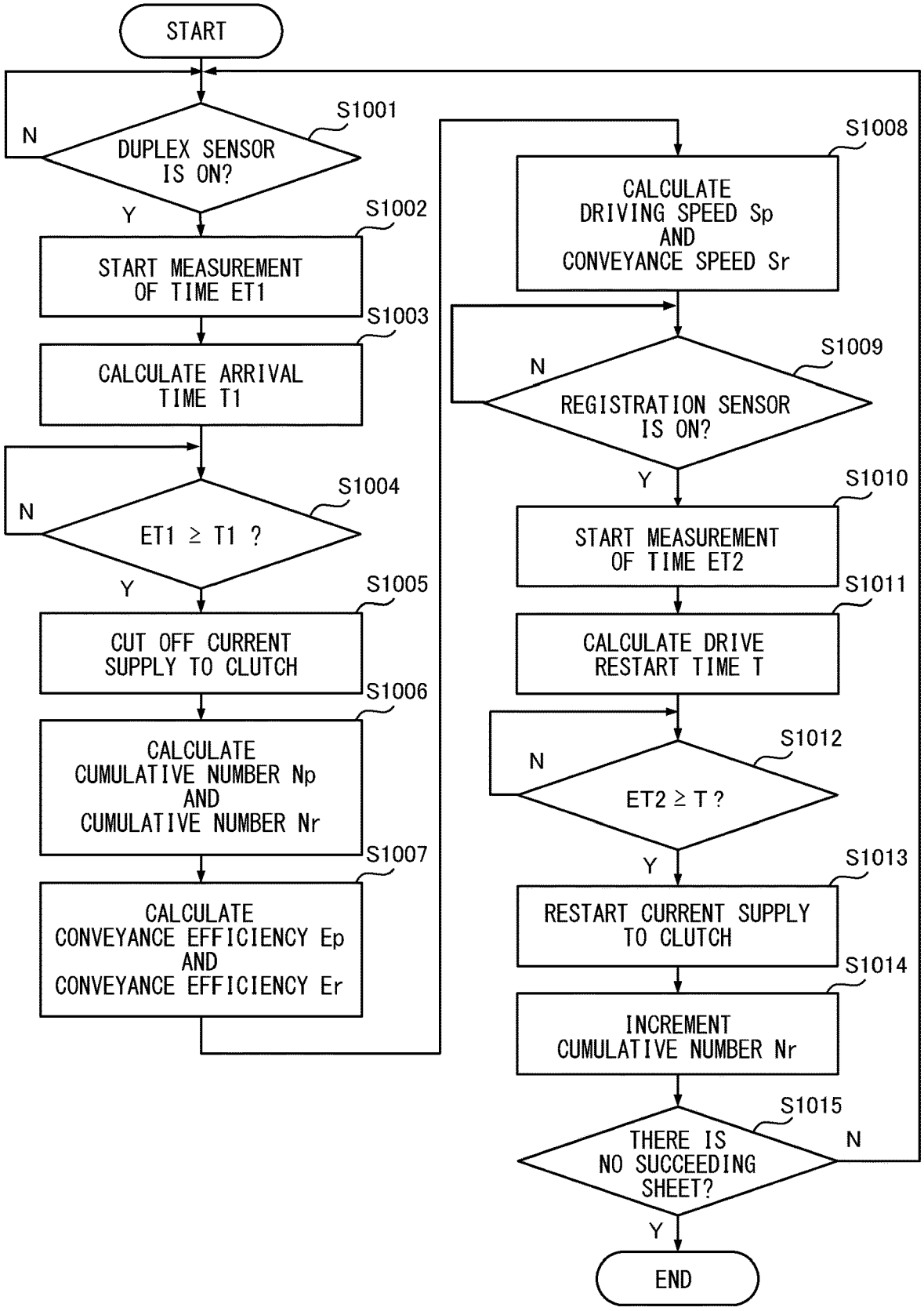
FIG. 10 is a flowchart illustrating the flow of a duplex conveyance sequence according to the present embodiment.

FIG. 10 is a flowchart illustrating the flow of the duplex conveyance sequence in the image forming apparatus 1. This flowchart is executed only during two-side printing. In FIG. 10, it is noted that the sheet fed from the sheet feed unit 110 toward the pre-registration roller pair 186 is described as the sheet P1 serving as a first sheet, and the sheet reversely conveyed by the reverse conveyance portion 190B is described as the sheet P2 as a second sheet. When the two-side printing job is input, the leading edge of the sheet P2 conveyed on two sides in the sheet conveyance direction reaches the detection position of the duplex sensor 275, and the sensor output of the duplex sensor 275 switches from OFF to ON. First, the CPU 301 determines whether or not the duplex sensor 275 has been switched from OFF to ON (step S1001). When it is determined that the duplex sensor 275 has been switched from OFF to ON (step S1001/Y), the CPU 301 acquires the distance Lr between the duplex sensor 275 and the duplex roller pair 185 and the conveyance speed of the sheet P2 recorded in the ROM 302. Next, the CPU 301 causes the timer 276 to measure the elapsed time ET1 from the timing when the sensor output of the duplex sensor 275 switches from OFF to ON (step S1002).

Then, the CPU 301 calculates the timing for stopping the driving of the clutch 273 based on the distance Lr and the conveyance speed of the sheet P2 (step S1003). In the present embodiment, in order to correct the difference in conveyance efficiencies of the pre-registration roller pair 186 and the duplex roller pair 185, a stop process of temporarily stopping the sheet that has reached the duplex roller pair 185 is executed. Then, the conveyance restart timing of the sheet P2 is changed according to the conveyance status of the sheet P1 conveyed by the pre-registration roller pair 186. As a result, the inter-sheet distance between the sheet P1 and the sheet P2 is made constant. In step S1003, the CPU 301 calculates the time required for the leading edge of the sheet P2 to pass from the detection position of the duplex sensor 275 to reach the duplex roller pair 185, that is, the arrival time T1, by using the above described equation (1). Next, the CPU 301 determines whether the elapsed time ET1 is equal to or longer than the arrival time T1 (step S1004).

When it is determined that the elapsed time ET1 has been equal to or longer than the arrival time T1 (step S1004/Y), the CPU 301 cuts off the current supply to the clutch 273 (step S1005), and stops driving of the duplex roller pair 185. When the driving of the duplex roller pair 185 stops, the conveyance of the sheet P2 also stops. That is, the CPU 301 executes the stop process of stopping the sheet P2 in the state in which the sheet P2 is nipped by the duplex roller pair 185 by making the clutch 273 be the non-transmission state. Next, the CPU 301 acquires, from the RAM 303, cumulative numbers Np and Nr of the sheets conveyed by the pre-registration roller pair 186 and the duplex roller pair 185, respectively (step S1006). A second number of sheets in the present embodiment is the cumulative number Nr of sheets conveyed by the duplex roller pair 185, and a first number of sheets in the present embodiment is the cumulative number Np of sheets conveyed by the pre-registration roller pair 186. The CPU 301 obtains a conveyance efficiency Ep (%) of the pre-registration roller pair 186 and a conveyance efficiency Er (%) of the duplex roller pair 185 based on the cumulative number Np of sheets and the cumulative number Nr of sheets, by using the following equations (3-1) and (3-2) (step S1007).

$$Ep=100-(Np\times 10)\div 300{,}000 \tag{3-1}$$

$$Er=100-(Nr\times 10)\div 300{,}000 \tag{3-2}$$

In step S1007, it is noted that the conveyance efficiency corresponding to the cumulative number of sheets may be obtained by referring to the relational expression (see FIG. 6) between the conveyance efficiency and the cumulative number of sheets and the data table (see FIG. 7) in which the conveyance efficiency corresponding to the cumulative number of sheets is predetermined.

The CPU 301 calculates a driving speed Sp of the pre-registration motor 272 and a conveyance speed Sr of the duplex roller pair 185 based on the conveyance efficiency Ep and the conveyance efficiency Er obtained in step S1007 (step S1008). In the present embodiment, the conveyance speed of the sheet conveyed by the pre-registration roller pair 186 is made constant (200 mm/sec). Therefore, the driving speed Sp of the pre-registration motor 272 is obtained based on the conveyance efficiency Ep of the pre-registration roller pair 186. In step S1008, the CPU 301 calculates the driving speed Sp of the pre-registration motor 272 by using the following equation (4-1).

$$Sp=200\times 100\div Ep \tag{4-1}$$

In step S1008, the CPU 301 calculates the conveyance speed Sr of the sheet by the duplex roller pair 185 based on the driving speed Sp of the pre-registration motor 272 by using the following equation (4-2).

$$Sr=Sp\times Er\div 100 \quad (4\text{-}2)$$

Thereafter, while the sheet P2 is being conveyed toward the duplex roller pair 185, the sheet P1 is fed from the sheet feed unit 110, and the leading edge of the sheet P1 in the sheet conveyance direction reaches the detection position as a reference position of the registration sensor 274. Then, the sensor output of the registration sensor 274 changes from OFF to ON. The CPU 301 checks whether or not the sensor output of the registration sensor 274 has been switched from OFF to ON by the sheet P1 (step S1009). When the sensor output of the registration sensor 274 switches to ON (step S1009/Y), the CPU 301 causes the timer 276 to measure the elapsed time ET2 from the timing when the sensor output of the registration sensor 274 switches from OFF to ON (step S1010). Next, the CPU 301 acquires information for calculating the drive restart time T from the RAM 303 and the ROM 302. The drive restart time T is a time until a conveyance restart process of restarting conveyance of the sheet P2 stopped by the duplex roller pair 185 is executed by transitioning the clutch 273 from the non-transmission state to the transmission state after the sheet P1 has passed the detection position of the registration sensor 274. Specifically, the CPU 301 acquires information on the length Ln (mm) of the sheet P1 in the sheet conveyance direction from the RAM 303 and information on the distance Lp (mm) between the detection position of the registration sensor 274 and the pre-registration roller pair 186 from the ROM 302. Then, based on the length L1 of the sheet P1, the distance Lp, and the conveyance speed Sr of the duplex roller pair 185, the CPU 301 calculates the drive restart time T for restarting the conveyance of the sheet P2 from the duplex roller pair 185 by using the following equation (5) (step S1011).

$$T=(L1-Lp+5)\div 200\times 1{,}000-35\div Sr\times 1{,}000 \quad (5)$$

As described above, in the present embodiment, after the sheets are temporarily stopped by the duplex roller pair 185, the conveyance of the succeeding sheet is restarted according to the conveyance status of the precedingly conveyed sheet such that the inter-sheet distance between the preceding sheet and the succeeding sheet is made constant. Therefore, in step S1011, the CPU 301 calculates the drive restart time T such that when the leading edge of the sheet P2 reaches the pre-registration roller pair 186 in the sheet conveyance direction, the trailing edge of the sheet P1 is located at a predetermined position. Here, when the leading edge of the sheet P2 reaches the pre-registration roller pair 186, the drive restart time T is calculated such that the trailing edge of the sheet P1 is located at a position 5 mm downstream of the pre-registration roller pair 186.

More specifically, the CPU 301 has a first mode in which the conveyance restart process of restarting the conveyance of the sheet P2 is performed at the drive restart timing t4 as the first timing at which the drive restart time T2 as a first time has elapsed since the leading edge of the sheet P1 has passed the detection position of the registration sensor 274. Further, the CPU 301 has a second mode in which the conveyance restart process of restarting the conveyance of the sheet P2 is performed at the drive restart timing t4α as the second timing at which a drive restart time T3 as a second time has elapsed since the leading edge of the sheet P1 has passed the detection position of the registration sensor 274. Further, the CPU 301 has a third mode in which the conveyance restart process of restarting the conveyance of the sheet P2 is performed at the drive restart timing t4β as the third timing at which a drive restart time T4 as a third time has elapsed since the leading edge of the sheet P1 has passed the detection position of the registration sensor 274. It is noted that the drive restart time T includes the drive restart times T2, T3, and T4, and the relationship between the drive restart times T2, T3, and T4 is T4<T2<T3. That is, the drive restart time T3 is longer than the drive restart time T2, and the drive restart time T4 is shorter than the drive restart time T2. Further, the CPU 301 may not have the third mode.

The CPU 301 executes one of the first mode, the second mode, and the third mode according to the conveyance efficiency of the sheet by the pre-registration roller pair 186 and the conveyance efficiency of the sheet by the duplex roller pair 185. That is, the first mode is executed when the conveyance efficiency of the sheet by the pre-registration roller pair 186 and the conveyance efficiency of the sheet by the duplex roller pair 185 are the same. The case where the conveyance efficiency of the sheet by the pre-registration roller pair 186 and the conveyance efficiency of the sheet by the duplex roller pair 185 are the same is, for example, a case where the first number of sheets, which is the cumulative number of sheets conveyed by the pre-registration roller pair 186, and the second number of sheets, which is the cumulative number of sheets conveyed by the duplex roller pair 185, are the same. In this case, the first conveyance speed, which is the conveyance speed of the sheet by the pre-registration roller pair 186, is the same as the second conveyance speed, which is the conveyance speed of the sheet by the duplex roller pair 185. It is noted that the pre-registration roller pair 186 and the duplex roller pair 185 are driven by a single pre-registration motor 272.

Further, the CPU 301 executes the second mode when the conveyance efficiency of the sheet by the pre-registration roller pair 186 is lower than the conveyance efficiency of the sheet by the duplex roller pair 185. The case where the conveyance efficiency of the sheet by the pre-registration roller pair 186 is lower than the conveyance efficiency of the sheet by the duplex roller pair 185 is, for example, the case where the first number of sheets is larger than the second number of sheets. In this case, as illustrated in FIG. 7B, the CPU 301 increases the speed of the pre-registration motor 272 from that in the first mode such that the first conveyance speed becomes, for example, 200 mm/sec as a predetermined speed. Therefore, the second conveyance speed becomes faster than the first conveyance speed.

Further, the CPU 301 executes the third mode when the conveyance efficiency of the sheet by the pre-registration roller pair 186 is higher than the conveyance efficiency of the sheet by the duplex roller pair 185. The case where the conveyance efficiency of the sheet by the pre-registration roller pair 186 is higher than the conveyance efficiency of the sheet by the duplex roller pair 185 is, for example, the case where the first number of sheets is smaller than the second number of sheets. In this case, as illustrated in FIG. 7C, the second conveyance speed becomes slower than the first conveyance speed.

Next, the CPU 301 determines whether the elapsed time ET2 is equal to or longer than the drive restart time T (step S1012). When it is determined that the elapsed time ET2 has been equal to or longer than the drive restart time T (step S1012/Y), the CPU 301 restarts the current supply to the clutch 273 (step S1013), and drives the duplex roller pair 185. When the conveyance of the sheet P2 is restarted by driving of the duplex roller pair 185 and the conveyed sheet P2 passes through the detection position of the duplex sensor 275, the sensor output of the duplex sensor 275 switches from ON to OFF. When the sensor output of the duplex sensor 275 switches from ON to OFF, the CPU 301 increments the cumulative number Nr of sheets by one (step S1014). Then, the CPU 301 determines whether there is no sheet fed from the sheet feed unit 110 following the sheet P1 (step S1015). When it is determined that there is no sheet to be subsequently fed (step S1015/Y), the CPU 301 ends this processing, and when it is determined that there is a sheet to be subsequently fed (step S1015/N), the CPU 301 executes the series of operations again from step S1001.

As described above, in the present embodiment, when the two roller pairs are driven by one motor, the conveyance timing of the sheet conveyed on two sides is changed according to the conveyance efficiency of each roller pair and the cumulative number of sheets conveyed by each roller pair. As a result, the sheet conveyance interval can be made constant, so that it is possible to avoid a jam such as a collision between sheets or a sheet conveyance delay caused by a difference in conveyance speeds between the roller pairs.

OTHER EMBODIMENTS

As a configuration in which the two roller pairs are driven by one motor, for example, in a case where a plurality of sheet feed units are provided in the image forming apparatus 1, the feeding start timing from the sheet feed unit on the upstream side in the sheet conveyance direction may be changed in the same manner as in Embodiment 1. In the image forming apparatus 1 having the plurality of sheet feed units, the cumulative number of sheets conveyed by roller pairs of the sheet feed unit on the downstream side in the sheet conveyance direction is larger than that of roller pairs of the sheet feed unit on the upstream side in the sheet conveyance direction. Therefore, the same effect as that of Embodiment 1 can be obtained by changing the feeding start timing from the sheet feed unit on the upstream side in the sheet conveyance direction, similar to Embodiment 1.

In Embodiment 1, the description has been made on the assumption that the conveyance efficiency of the roller pair changes according to the cumulative number of sheets. However, the conveyance efficiency also changes according to the installation location of the image forming apparatus 1 or the grammage, material, and the like of the sheet used for image formation. Therefore, a configuration may be adopted in which a change in the conveyance efficiency of the roller pair is acquired in advance as a test value for each temperature, humidity, grammage, and material and stored as a table, and a change in the conveyance efficiency of the roller pair is obtained. Further, the present invention is not limited to the conveyance efficiency of the roller pair, and the timing at which the conveyance restart process is performed may be changed according to the conveyance efficiency of the conveyance portion including, for example, a belt.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-091952, filed May 15, 2019, and Japanese Patent Application No. 2020-070552, filed Apr. 9, 2020, which are hereby incorporated by reference herein in their entirety.

What is claimed is:

1. A sheet conveyance apparatus comprising:
- a first conveyance path;
- a second conveyance path that merges with the first conveyance path at a merging portion;
- a first conveyance portion configured to convey a first sheet in the first conveyance path;
- a second conveyance portion configured to convey a second sheet toward the merging portion in the second conveyance path;
- a driving unit configured to drive the first conveyance portion and the second conveyance portion;
- a drive force transmitting portion configured to transition between a transmission state in which a drive force from the driving unit is transmitted to drive the second conveyance portion and a non-transmission state in which a drive force from the driving unit is not transmitted to the second conveyance portion; and
- a control unit configured to execute a stop process of stopping the second sheet in a state in which the second sheet is nipped by the second conveyance portion by making the drive force transmitting portion be the non-transmission state, and a conveyance restart process of restarting conveyance of the second sheet stopped by the second conveyance portion by transitioning the drive force transmitting portion from the non-transmission state to the transmission state,
- wherein the control unit has a first mode in which the conveyance restart process is performed at a first timing at which a first time has elapsed since the first sheet has passed a reference position, and a second mode in which the conveyance restart process is performed at a second timing at which a second time longer than the first time has elapsed since the first sheet has passed the reference position.

2. The sheet conveyance apparatus according to claim 1, wherein the control unit executes the first mode in a case where a first number of sheets, which is a cumulative number of sheets conveyed by the first conveyance portion, and a second number of sheets, which is a cumulative number of sheets conveyed by the second conveyance portion, are the same, and executes the second mode in a case where the first number of sheets is larger than the second number of sheets.

3. The sheet conveyance apparatus according to claim 1, wherein the control unit executes the first mode in a case where a conveyance efficiency of a sheet by the first conveyance portion and a conveyance efficiency of a sheet by the second conveyance portion are the same, and executes the second mode in a case where a conveyance efficiency of a sheet by the first conveyance portion is lower than a conveyance efficiency of a sheet by the second conveyance portion.

4. The sheet conveyance apparatus according to claim 3, wherein the control unit changes a driving speed of the driving unit according to the conveyance efficiency of the sheet by the first conveyance portion.

5. The sheet conveyance apparatus according to claim 3, wherein the first conveyance portion is driven by the driving unit regardless of whether the drive force transmitting portion is in the transmission state or the non-transmission state, and the control unit changes a driving speed of the driving unit according to the conveyance efficiency of the sheet by the first conveyance portion such that a conveyance speed of the sheet by the first conveyance portion becomes a predetermined speed.

6. The sheet conveyance apparatus according to claim 1, wherein the control unit executes the first mode in a case where a first conveyance speed, which is a conveyance speed of a sheet by the first conveyance portion, and a second conveyance speed, which is a conveyance speed of a sheet by the second conveyance portion, are the same, and executes the second mode in a case where the second conveyance speed is greater than the first conveyance speed.

7. The sheet conveyance apparatus according to claim 1, wherein the control unit has a third mode in which the conveyance restart process is performed at a third timing at which a third time shorter than the first time has elapsed since the first sheet has passed the reference position.

8. The sheet conveyance apparatus according to claim 7, wherein the control unit executes the first mode in a case where a first number of sheets, which is a cumulative number of sheets conveyed by the first conveyance portion, and a second number of sheets, which is a cumulative number of sheets conveyed by the second conveyance portion, are the same, executes the second mode in a case where the first number of sheets is larger than the second number of sheets, and executes the third mode in a case where the first number of sheets is smaller than the second number of sheets.

9. The sheet conveyance apparatus according to claim 7, wherein the control unit executes one of the first mode, the second mode, and the third mode according to a conveyance efficiency of a sheet by the first conveyance portion and a conveyance efficiency of a sheet by the second conveyance portion.

10. The sheet conveyance apparatus according to claim 9, wherein the control unit executes the first mode in a case where the conveyance efficiency of the sheet by the first conveyance portion and the conveyance efficiency of the sheet by the second conveyance portion are the same, executes the second mode in a case where the conveyance efficiency of the sheet by the first conveyance portion is lower than the conveyance efficiency of the sheet by the second conveyance portion, and executes the third mode in a case where the conveyance efficiency of the sheet by the first conveyance portion is higher than the conveyance efficiency of the sheet by the second conveyance portion.

11. The sheet conveyance apparatus according to claim 10, wherein the control unit changes a driving speed of the driving unit according to the conveyance efficiency of the sheet by the first conveyance portion.

12. The sheet conveyance apparatus according to claim 10, wherein the first conveyance portion is driven by the driving unit regardless of whether the drive force transmitting portion is in the transmission state or the non-transmission state, and the control unit changes a driving speed of the driving unit according to the conveyance efficiency of the sheet by the first conveyance portion such that a conveyance speed of the sheet by the first conveyance portion becomes a predetermined speed.

13. The sheet conveyance apparatus according to claim 7, wherein the control unit executes the first mode in a case where a first conveyance speed, which is a conveyance speed of a sheet by the first conveyance portion, and a second conveyance speed, which is a conveyance speed of a sheet by the second conveyance portion, are the same, executes the second mode in a case where the second conveyance speed is greater than the first conveyance speed, and executes the third mode in a case where the second conveyance speed is smaller than the first conveyance speed.

14. The sheet conveyance apparatus according to claim 1, further comprising a first detection unit configured to detect the first sheet at the reference position.

15. The sheet conveyance apparatus according to claim 14, further comprising a second detection unit disposed upstream of the second conveyance portion in a sheet conveyance direction and configured to detect the second sheet conveyed through the second conveyance path, wherein the control unit executes the stop process according to a detection result of the second detection unit.

16. The sheet conveyance apparatus according to claim 1, wherein the first conveyance portion is disposed downstream of the merging portion in a sheet conveyance direction.

17. The sheet conveyance apparatus according to claim 1, further comprising a third conveyance portion configured to guide the first sheet to the second conveyance path by conveying the first sheet conveyed through the first conveyance path in a first direction and then conveying the first sheet in a second direction opposite to the first direction.

18. An image forming apparatus comprising:

the sheet conveyance apparatus according to claim 1; and an image forming unit configured to form an image on the first sheet that has passed through the first conveyance portion.

* * * * *